US008938986B2

(12) United States Patent
Matta et al.

(10) Patent No.: US 8,938,986 B2
(45) Date of Patent: Jan. 27, 2015

(54) MODULAR SYSTEM FOR THERMALLY CONTROLLED PACKAGING DEVICES

(75) Inventors: Auston R. Matta, Chicago, IL (US); Craig M. Cless, Gilbertsville, PA (US); Philip T. Melcher, Fox River Grove, IL (US); Matthew J. MacMillan, Jenkintown, PA (US); Benjamin G. VanderPlas, Buffalo Grove, IL (US); Kenneth L. Maltas, Arlington Heights, IL (US); Kushal S. Amin, Arlington Heights, IL (US)

(73) Assignee: Sonoco Development, Inc., Hartsville, SC (US)

( * ) Notice: Subject to any disclaimer, the term of this patent is extended or adjusted under 35 U.S.C. 154(b) by 223 days.

(21) Appl. No.: 13/342,761

(22) Filed: Jan. 3, 2012

(65) Prior Publication Data

US 2012/0305435 A1 Dec. 6, 2012

Related U.S. Application Data

(60) Provisional application No. 61/429,646, filed on Jan. 4, 2011.

(51) Int. Cl.

| | |
|---|---|
| ***F25D 3/08*** | (2006.01) |
| ***B65D 81/02*** | (2006.01) |
| ***B65D 81/38*** | (2006.01) |

(52) U.S. Cl.

CPC ..... *B65D 81/3862* (2013.01)
USPC ..... 62/371; 62/457.1; 62/530; 206/594

(58) Field of Classification Search

CPC ..... B65D 81/107; B65D 81/3862
USPC ..... 62/60, 62, 371, 457.1, 457.2, 530; 165/104.13; 206/521, 523, 526, 591, 206/592, 594; 229/101

See application file for complete search history.

(56) References Cited

U.S. PATENT DOCUMENTS

| | | | | |
|---|---|---|---|---|
| 2,861,681 | A | 11/1958 | Lane | |
| 2,951,624 | A | 9/1960 | Schwebs | |
| 2,954,140 | A * | 9/1960 | Sutherland et al. | 206/591 |
| 3,334,798 | A * | 8/1967 | Pezely, Jr. et al. | 206/594 |
| 4,586,602 | A * | 5/1986 | Levey | 206/591 |
| 5,582,028 | A * | 12/1996 | Rilling et al. | 62/530 |
| 5,595,069 | A * | 1/1997 | Gies | 62/530 |
| 5,626,936 | A | 5/1997 | Alderman | |
| 5,899,088 | A | 5/1999 | Purdum | |
| 6,347,700 | B1 * | 2/2002 | Redfield et al. | 206/521 |
| 6,364,199 | B1 | 4/2002 | Rose | |

(Continued)

*Primary Examiner* — Luan K Bui
(74) *Attorney, Agent, or Firm* — Dorsey & Whitney LLP

(57) ABSTRACT

A modular container for maintaining an article under controlled temperature conditions includes a generally rectangular box-shaped enclosure defining an interior volume, wherein at least one enclosure side includes an access opening to allow for insertion or removal of the article within the interior volume, and wherein enclosure sides may be made of an insulating material. The modular container further includes at least two first phase change elements including a first phase change material, wherein each of said at least two first phase change elements is positioned adjacent one of a pair of opposed enclosure sides, at least two buffer inserts disposed within said enclosure, and at least two second phase change elements including a second phase change material, to one of the at least two buffers inserts wherein the second phase change material changes phase at a different temperature than the first phase change material.

34 Claims, 32 Drawing Sheets

(56) References Cited

U.S. PATENT DOCUMENTS

| | | | | |
|---|---|---|---|---|
| 6,574,971 | B2 | 6/2003 | Suppes | |
| 7,257,963 | B2 | 8/2007 | Mayer | |
| 7,455,214 | B2 | 11/2008 | Miller et al. | |
| 7,908,870 | B2 * | 3/2011 | Williams et al. | 62/62 |
| 8,424,335 | B2 * | 4/2013 | Corder et al. | 62/371 |
| 8,443,623 | B2 * | 5/2013 | Matta et al. | 62/457.2 |
| 2004/0112947 | A1 | 6/2004 | Davidsson | |
| 2008/0276643 | A1 * | 11/2008 | Heroux et al. | 62/457.2 |
| 2009/0039088 | A1 | 2/2009 | Williams et al. | |
| 2011/0083826 | A1 | 4/2011 | Matta et al. | |

* cited by examiner

TEMPERATURE RANGE

DURATION

| | <-15°C | 2-8°C | 15-30°C |
|---|---|---|---|
| 24 hrs | Payload Size: 8L<br>Insulation: EPS | | |
| 48 hrs | | Payload Size: 8L<br>Insulation: EPS | |
| 72 hrs | | Payload Size: 8L<br>Insulation: PUR | Payload Size: 8L<br>Insulation: PUR |
| 96 hrs | | Payload Size: 5L<br>Insulation: PUR | |

FIG. 3d

Fig. 4a
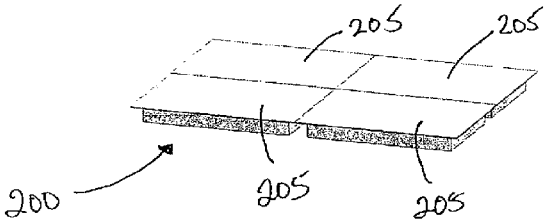
Fig. 4b
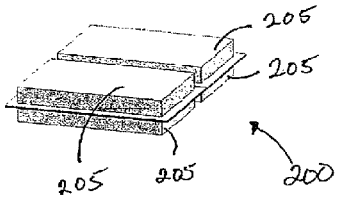
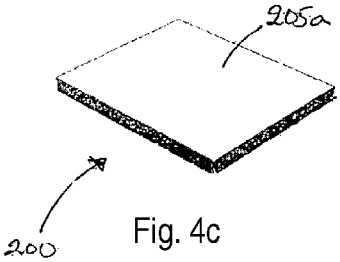
Fig. 4c
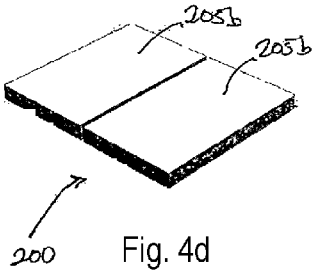
Fig. 4d
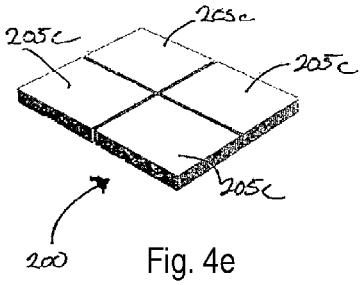
Fig. 4e

MODULAR SYSTEM FOR THERMALLY CONTROLLED PACKAGING DEVICES

FIELD OF THE DISCLOSURE

The present disclosure relates to systems for thermally controlling articles for shipment or transport. More specifically, the present disclosure relates to a modular packaging container and method for temperature sensitive articles.

BACKGROUND

Thermally controlled shipping systems are used to transport a variety of temperature sensitive products and goods including, for example, biological products, pharmaceuticals, perishable foodstuffs, and other high-value materials that require controlled temperatures, varying from below freezing to room temperature. The thermal objective for such a system is to maintain a predetermined temperature range in order to protect the payload, i.e., the article(s) being shipped, from experiencing harmful external environmental temperature fluctuations. Typical thermally controlled shipping systems are designed to insulate the payload and maintain a predetermined temperature, whether cooler or warmer relative to ambient temperatures.

Biological products such as blood, biopharmaceuticals, reagents, and vaccines with required storage refrigeration conditions are commonly transported using thermally controlled shipping systems. Because of these products' susceptibility to the external environmental temperature, increased regulatory scrutiny of product transport conditions has been implemented to ensure the viability of the payload being shipped. Accordingly, shippers have had to make costly upgrades to their shipping systems and procedures to ensure compliance.

It is thus common practice to employ Temperature Control Management Chain (TCMC) shipment systems and methods to ensure product integrity and regulatory compliance during transportation. A TCMC is a temperature-controlled supply chain. An unbroken TCMC is an uninterrupted series of storage and distribution activities which maintain a given temperature range or prevent exceeding some temperature limit. Such TCMCs are common in the food and pharmaceutical industries, and also for some chemical shipments. One common temperature range for a TCMC in pharmaceutical industries is 2 to 8° C. Frozen (less than −15° C.) and controlled room temperature (15° C. to 30° C.) are also common temperature target ranges. However, the specific temperature (and time at temperature) tolerances depend on the actual product being shipped.

For example, with regard to vaccines, traditionally, all historical stability data developed for vaccines was based on the temperature range of 2-8° C. With recent development of biological products by former vaccine developers, biologics have fallen into the same category of storage at 2-8° C., due to the nature of the products and the lack of testing for these products at wider storage conditions.

The TCMC distribution process is an extension of the Current Good Manufacturing Practices (cGMP) environment to which all drugs and biological products must adhere, as enforced by the U.S. Food and Drug Administration (FDA) or comparable authorities outside the United States. As such, the distribution process must be validated to ensure that there is no negative impact to the safety, efficacy, or quality of the drug substance. The cGMP environment begins with all things that are used to manufacture a drug substance, and it does not end until that drug substance is administered to a patient. Therefore, all processes that might impact the safety, efficacy, or quality of the drug substance must be validated, including storage and distribution of the ingredients and the drug substance.

Maintaining the TCMC can become particularly difficult in the distribution cycle before the end user receives the product. In order to meet this market need, insulated containers using specialty phase change materials (PCM) may be employed that can maintain the temperature of the product during transport and refrigerated storage.

In the past, various "off-the-shelf" container solutions, including those using PCM-based technologies, have been developed, usually for specific payloads. The current time-to-market for developing custom solutions not available "off-the-shelf" is lengthy, and is therefore undesirable by many customers, especially in the clinical trials, diagnostics, and research markets. As such, existing "off-the-shelf" solutions only satisfy a small portion of the market. In particular, existing "off-the-shelf" solutions offer no or very limited variability with regard to the available temperature ranges, time at temperature, and payload size.

Furthermore, there have been other regulatory trends in the art which have challenged the performance of thermally controlled packaging. Most existing thermally controlled systems employ small, parceled-sized packages. Although delivery companies generally do well at ensuring that the package arrives on time, they typically do not ensure that the package is transported in a particular orientation, even if specifically marked on the package. The FDA and other similar regulatory agencies recently have been made aware that most packaging is only designed to perform when shipped "upright" relative to the orientation of the payload. Consequently, enforcement of a requirement that a package work in any orientation is anticipated in the near future. For this reason, it is highly desirable for a thermally controlled package to perform equivalently regardless of its orientation while in transit.

Thus, what is needed in the art is a cold-chain container solution that reduces the need for custom container designs while still permitting a variety of different temperature range requirements to be met. What is further needed is for such a solution to perform consistently regardless of orientation during shipping.

BRIEF SUMMARY OF THE DISCLOSURE

The present disclosure generally describes a modular, platform approach to cold-chain container shipping wherein standard PCM sizes and configurations can be readily available or quickly customized to meet various temperature and duration criteria. In one embodiment, disclosed herein is a modular container for maintaining an article under controlled temperature conditions, which may include a generally rectangular box-shaped enclosure defining an interior volume, wherein at least one enclosure side may include an access opening to allow for insertion or removal of the article within the interior volume, and wherein enclosure sides may be made of an insulating material. The modular container may further include at least two first phase change elements including a first phase change material and disposed within said enclosure, wherein each of said at least two first phase change elements may be positioned adjacent one of a pair of opposed enclosure sides. Additionally, the modular container may include at least two buffer inserts disposed within said enclosure, wherein each of the at least two buffer inserts may be positioned adjacent to one of the at least two first phase change elements on an opposite side thereof from the sides of the enclosure, and wherein the at least two buffer inserts may be selectively interconnectable with each other to define a larger or a smaller payload volume for the article. The modular container may also include at least two second phase change elements including a second phase change material and disposed within said enclosure, wherein each of said at least two second phase change elements may be positioned adjacent to one of the at least two buffer inserts on an opposite side thereof from the first phase change elements, and wherein the second phase change material may change phase at a different temperature than the first phase change material.

In another embodiment, disclosed herein is a modular container for maintaining an article under controlled temperature conditions, which may include a generally rectangular box-shaped enclosure defining an interior volume, wherein at least one enclosure side may include an access opening to allow for insertion or removal of the article within the interior volume, and wherein enclosure sides may be made of an insulating material. The modular container may also include at least two first phase change elements including a first phase change material and disposed within said enclosure, wherein each of said at least two first phase change elements may be positioned adjacent one of a pair of opposed enclosure sides. The modular container may further include at least two buffer inserts disposed within said enclosure, wherein each of the at least two buffer inserts may be positioned adjacent to one of the at least two first phase change elements on an opposite side thereof from the sides of the enclosure to define a payload volume for the article. Additionally, the modular container may include at least two second phase change elements comprising a second phase change material and disposed within said enclosure, wherein each of said at least two second phase change elements may be positioned adjacent to one of the at least two buffer inserts on an opposite side thereof from the first phase change elements, and wherein the second phase change material may change phase at a different temperature than the first phase change material. Furthermore, the modular container may include a centering element disposed within said enclosure, wherein said centering element may be positioned adjacent to a side of the enclosure that is perpendicular to an orientation of the at least two first phase change elements, and wherein said centering element may be positioned in supporting contact with the at least two first phase change elements so as to support said elements centrally along the respective side of the enclosure to which said elements are adjacent.

In yet another embodiment, disclosed herein is a method for adjusting the thermal capacity of a modular container for maintaining an article under controlled temperature conditions, which may include providing: (1) a generally rectangular box-shaped enclosure defining an interior volume, wherein at least one enclosure side may include an access opening to allow for insertion or removal of the article within the interior volume, and wherein enclosure sides may be made of an insulating material; (2) at least two first phase change elements including a first phase change material and disposed within said enclosure, wherein each of said at least two first phase change elements may be positioned adjacent one of a pair of opposed enclosure sides; (3) at least two buffer inserts disposed within said enclosure, wherein each of the at least two buffer inserts may be positioned adjacent to one of the at least two first phase change elements on an opposite side thereof from the sides of the enclosure to define a payload volume for the article; and (4) at least two second phase change elements including a second phase change material and disposed within said enclosure, wherein each of said at least two second phase change elements may be positioned adjacent to one of the at least two buffer inserts on an opposite side thereof from the first phase change elements, and wherein the second phase change material may change phase at a different temperature than the first phase change material. The method may also include selecting an additional first phase change element or second phase change element, and positioning the selected additional phase change element adjacent to a like phase change element within the enclosure, wherein the selected additional phase change element may provide additional thermal capacity to the modular container.

In a further embodiment, disclosed herein is a modular container for maintaining an article under controlled temperature conditions, which may include a generally rectangular box-shaped enclosure defining an interior volume, wherein at least one enclosure side may include an access opening to allow for insertion or removal of the article within the interior volume, and wherein enclosure sides may be made of an insulating material. The modular container may also include at least four phase change elements comprising a phase change material and disposed within said enclosure, two of which may be disposed adjacent to a first side of the enclosure and the other two of which may be disposed adjacent to a second side of the enclosure. The modular container may further include at least two buffer inserts disposed within said enclosure, wherein each of the at least two buffer inserts may be positioned between two phase change elements at the first and second sides of the enclosure, and wherein the at least two buffer inserts may be selectively interconnectable with each other to define a larger or a smaller payload volume for the article and to provide structural support to maintain the phase change elements in their respective positions.

In still a further embodiment, disclosed herein is a modular container for maintaining an article under controlled temperature conditions, which may include a generally rectangular box-shaped enclosure defining an interior volume, wherein at least one enclosure side may include an access opening to allow for insertion or removal of the article within the interior volume, and wherein enclosure sides may be made of an insulating material. The modular container may also include at least two phase change elements including a phase change material and disposed within said enclosure, and at least two buffer inserts disposed within said enclosure. The at least two buffer inserts may interconnectable with each other to define an inner volume and an outer volume, the first volume being outside of a perimeter defined by the buffer inserts, between the buffer inserts and the sides of the enclosure, and the second volume being within the perimeter defined by the buffer inserts. The article may be disposed within the second volume. One of the at least two phase change elements may be disposed within the first volume and an other of the at least two phase change elements may be disposed within the second volume. Furthermore, the interconnectability of the buffer inserts may be selectively configurable to allow relative proportions of the inner and outer volumes to be adjusted to accommodate various sizes of phase change elements being disposed therein.

While multiple embodiments are disclosed, still other embodiments of the disclosure will become apparent to those having ordinary skill in the art from the following detailed description, which shows and describes illustrative embodiments of the disclosure. As will be realized, the embodiments described herein are capable of modification in various aspects, all without departing from the spirit and scope of the disclosure. Accordingly, the drawings and detailed description are to be regarded as illustrative in nature and not restrictive.

BRIEF DESCRIPTION OF THE FIGURES

While the specification concludes with claims particularly pointing out and distinctly claiming the subject matter that is regarded as forming the various embodiments of the present disclosure, it is believed that the embodiments will be better understood from the following description taken in conjunction with the accompanying figures, in which:

FIG. 3*d* is a chart of example modular configurations in accordance with the present disclosure.

FIGS. 4*a*-4*e* show sample embodiments of modular phase change elements as used with the present disclosure.

FIGS. 7*a*-7*c* show perspective views of three configurations for modular use of a centering ring in a thermally controlled packaging system in accordance with the present disclosure.

The figures provided herein are intended to be illustrative and broadly representative of certain embodiments of the present disclosure, and as such they should not be understood as requiring any scalar relationship of or between the various components depicted therein.

DETAILED DESCRIPTION

Overview of Thermally Controlled Packaging System

Figure 1A:
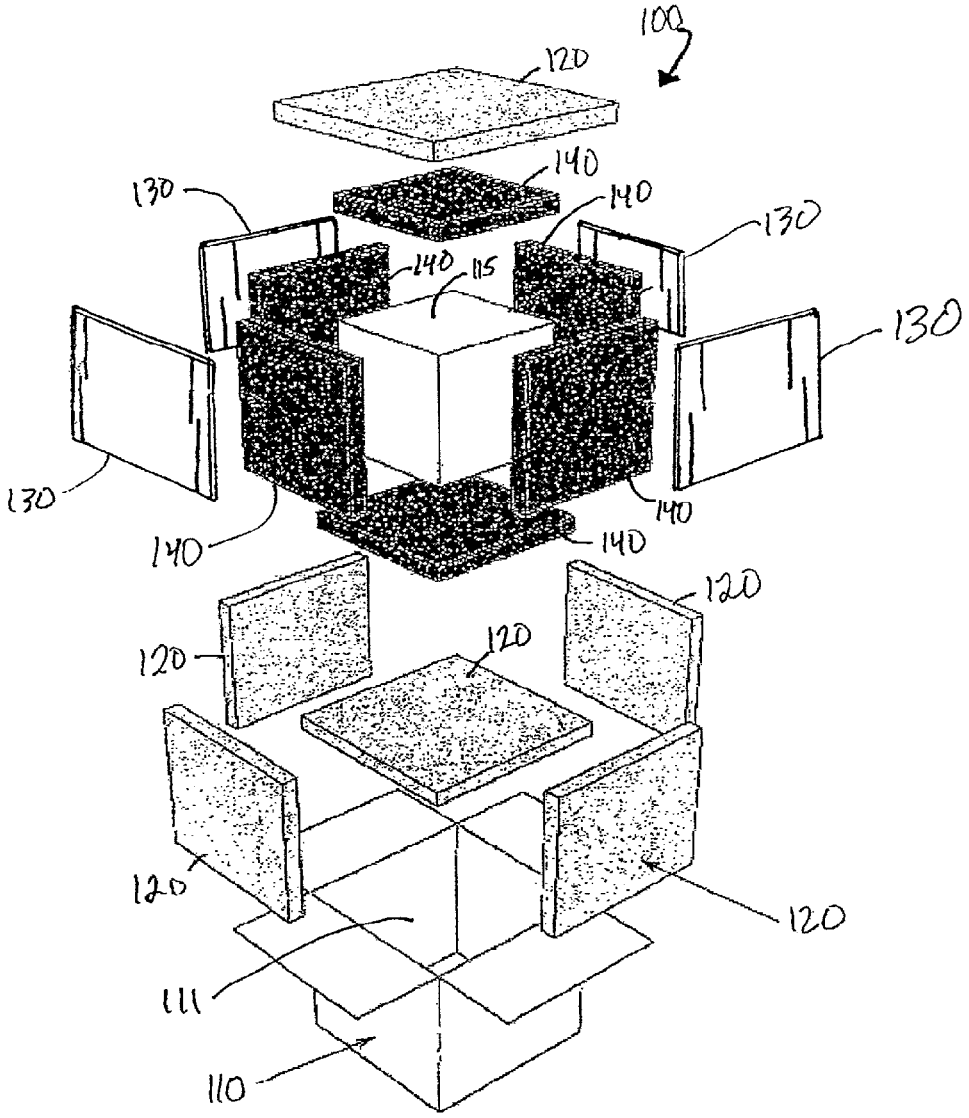
FIG. 1*a* is a deconstructed view of a rectangular box thermally controlled packaging system in accordance with the present disclosure.
Figure 1B:
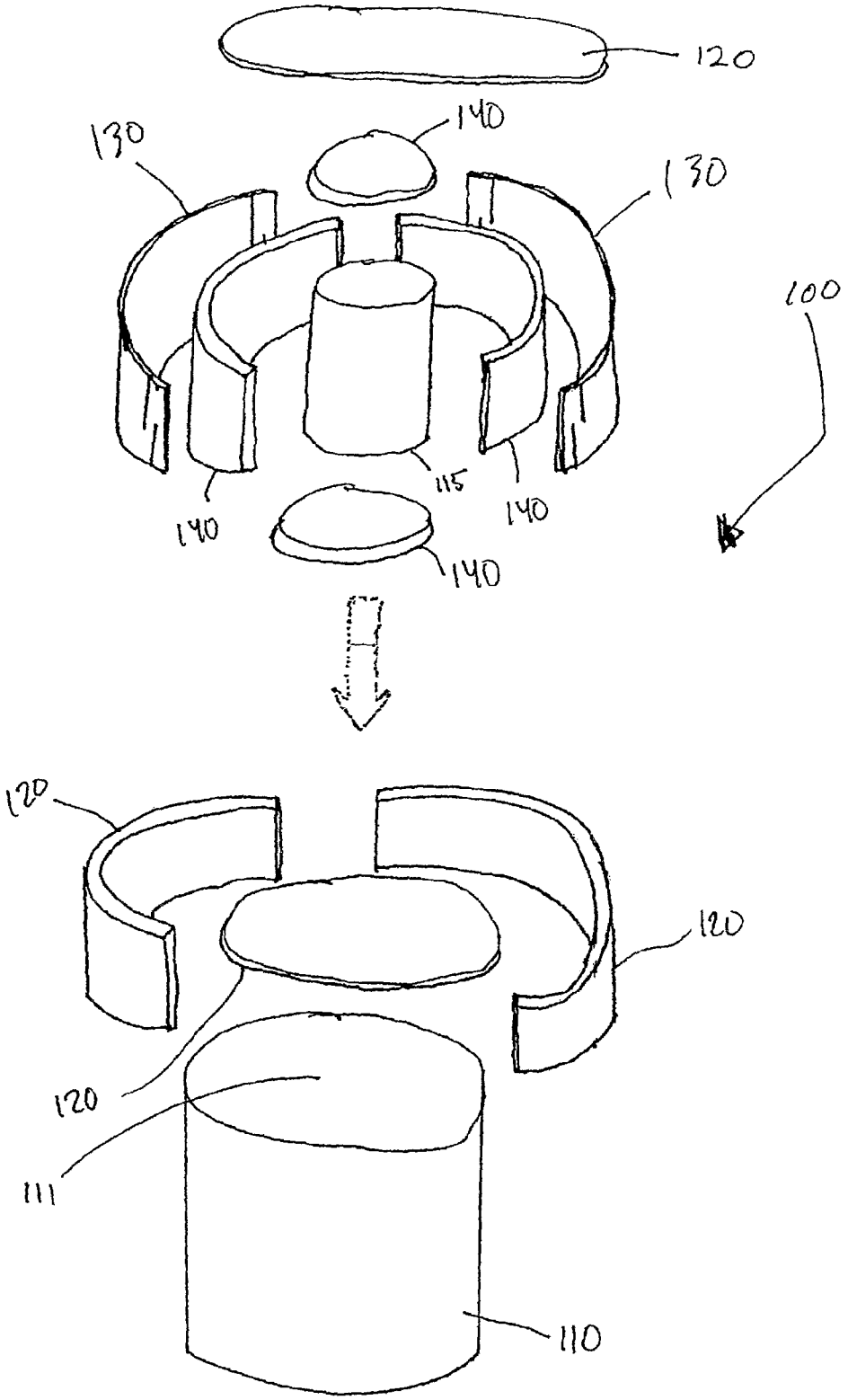
FIG. 1*b* is a deconstructed view of a cylindrical container thermally controlled packaging system in accordance with the present disclosure.
Figure 1C:
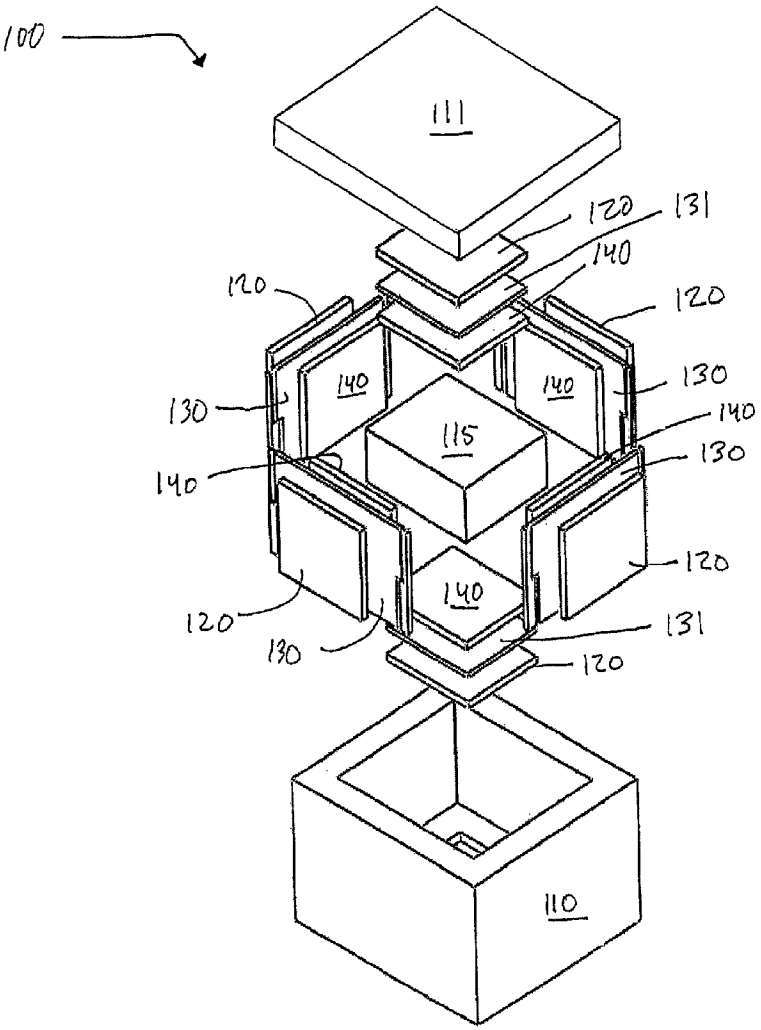
FIG. 1*c* is a deconstructed view of an alternate rectangular box thermally controlled packaging system in accordance with the present disclosure.
Figure 2:
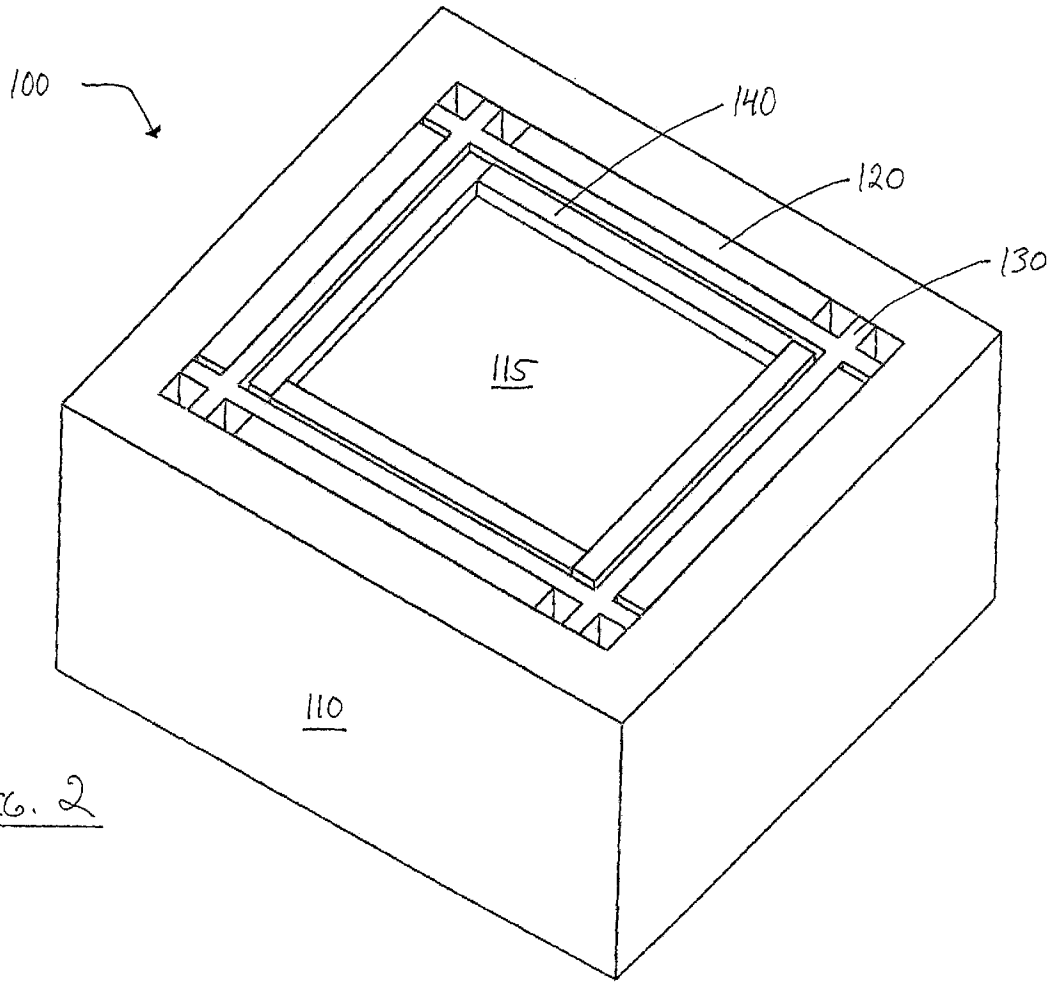
FIG. 2 is a perspective view looking into the interior of a thermally controlled packaging system in accordance with the present disclosure.

With general reference to FIGS. 1*a*-1*c*, 2, and 3*a*, a thermally controlled packaging system 100 for shipping a temperature sensitive article or payload 115 within a target temperature range is depicted. As shown therein, packaging system 100 is prepared for transport by inserting various system components and the article 115 into the enclosure 110. The enclosure 110, as will be described in greater detail below, may, in one embodiment, include a rectangular, six-sided box (FIG. 1*a*, 1*c*), with an access opening 111 at one side thereof to allow for the insertion or removal of the various system components and the shipped article 115. In an alternative embodiment, the enclosure 110 may generally include a generally cylindrical box (FIG. 1*b*), with an access opening 111 on a top side thereof. Other shapes and configurations of course are possible, as the configurations shown in FIGS. 1*a*, 1*c* and 1*b* are merely exemplary embodiments. The enclosure 110 may generally have both protective and insulating qualities—protective in that it provides a structurally rigid barrier to protect the article during the physical rigors of inter-modal shipping, and insulating in that it may be made of a material with relatively low thermal transfer characteristics. It thus represents a first layer of protection against ambient temperatures that are unfavorable relative to the target temperature range.

Figure 3A:
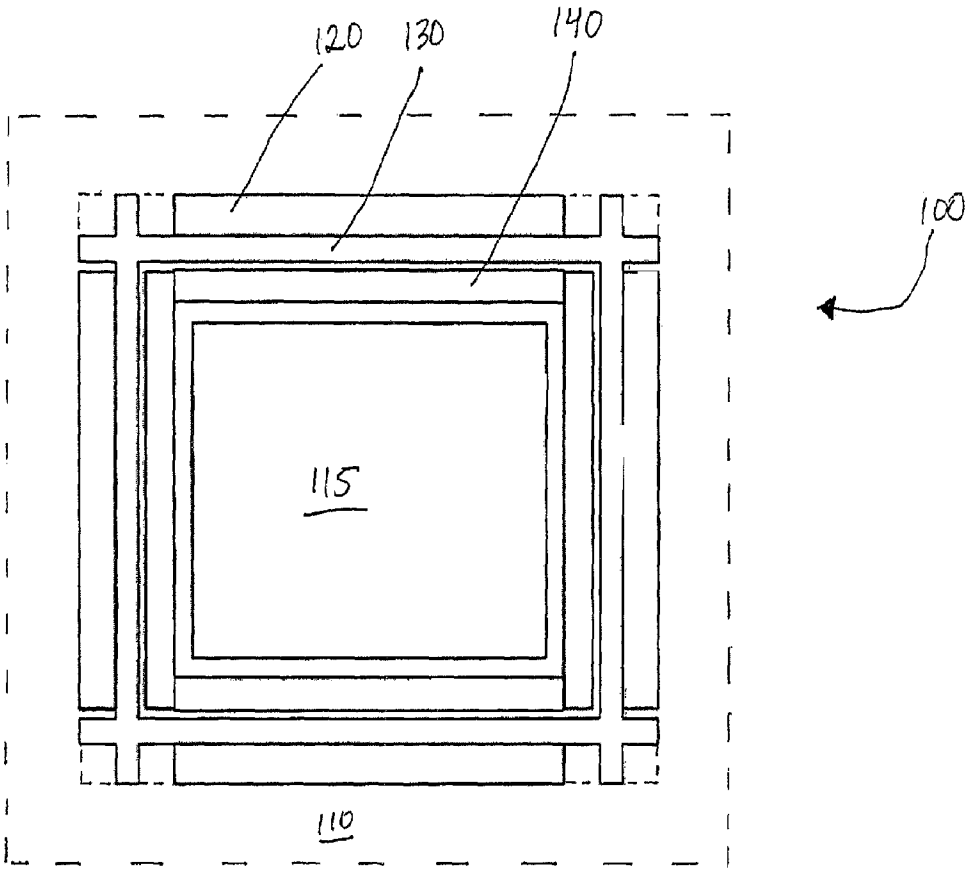
FIG. 3*a* is a top cross-sectional view of a thermally controlled packaging system in accordance with the present disclosure.
Figure 3B:
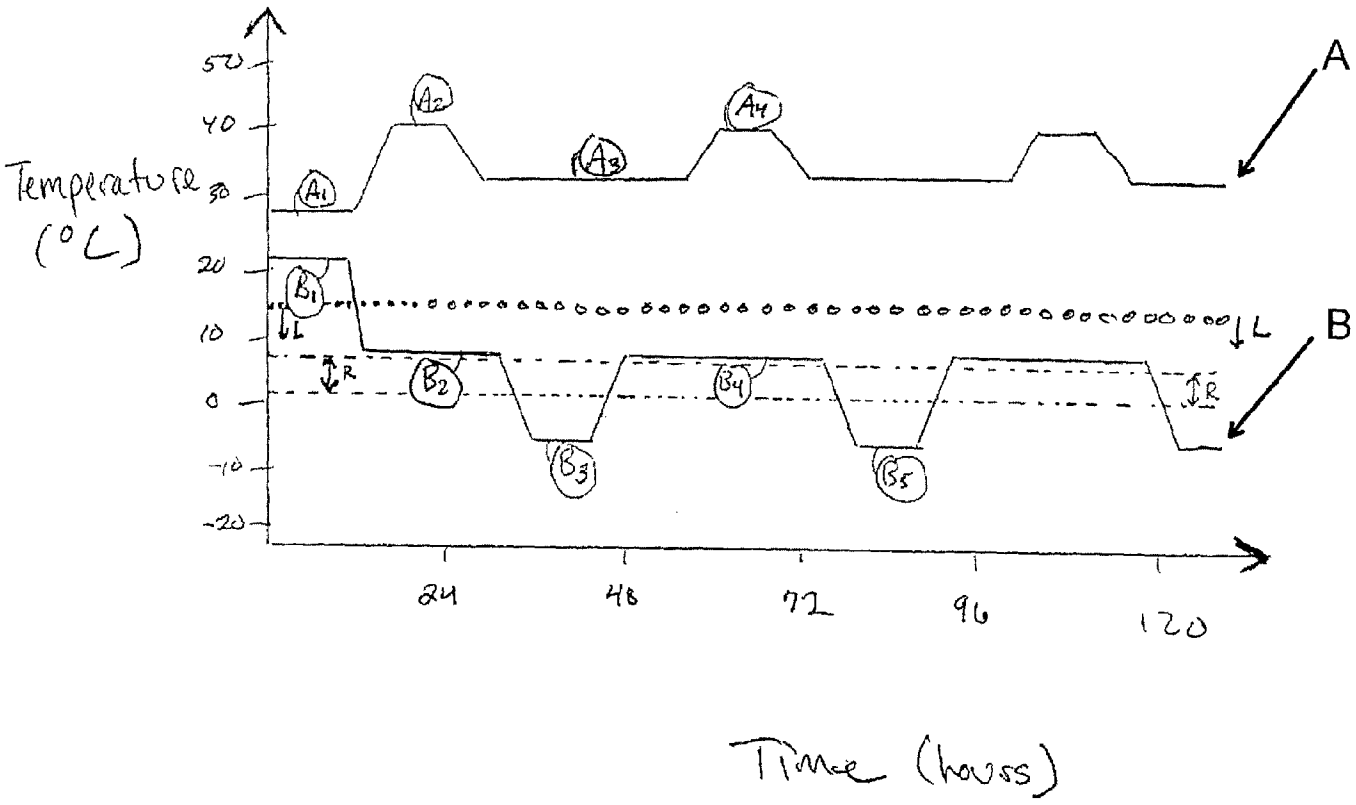
FIG. 3*b* is a graph of example assumed temperature profiles of warm season and cold season environments in which the disclosed packaging system may be used.
Figure 3C:
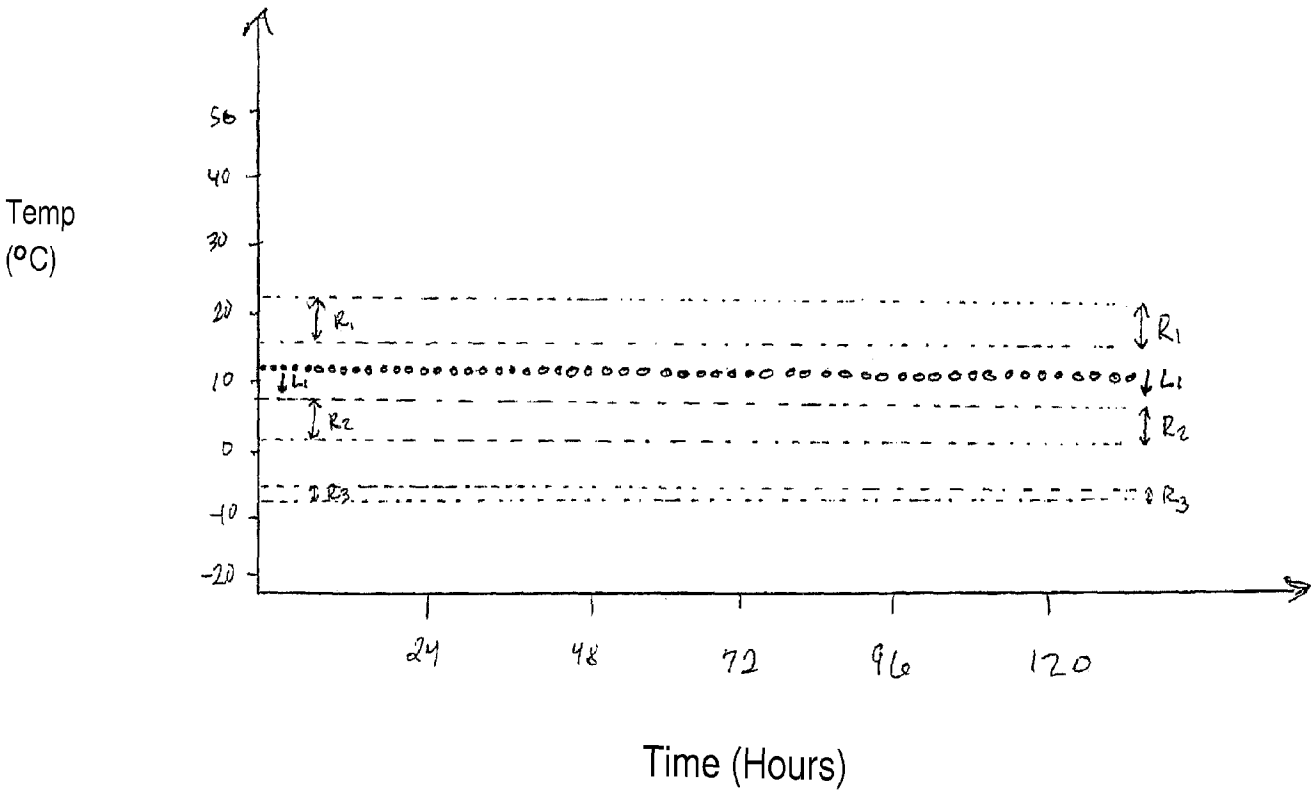
FIG. 3*c* is a graph of example temperature ranges maintained within the controlled packaging system of the present disclosure, including a "one-sided" range.

Depending on the shipping location of origin, destination, and mode(s) of transportation, a packaging system in accordance with the present disclosure may experience a wide range of ambient temperatures during shipping. The packaging system may be configured so as to provide effective thermal protection against such ambient temperatures, and maintain the shipped article within a desired temperature range, or above/below a desired temperature minimum/maximum. FIG. 3*b* shows two example ambient temperature profiles that may be experienced by a packaging system during the storage, transportation, and shipping process from the original article manufacturer to the end user. The upper line represents a hot season temperature profile, while the lower line represents a cold season profile. The total time from packaging to receipt may be up to 120 hours in some cases. Shipping durations of 24, 48, 72, and 96 hours are also common. The packaging system may generally be designed to protect against such temperature changes, and to keep the payload within a specified range of temperatures, denominated "R," which in the example of FIG. 3*b* is a temperature range from about 2 to 8° C. Other ranges, for example ranges R1 (about 15 to 22° C.), R2 (about 1 to 9° C.), and R3 (about −6 to −8° C.) as shown in FIG. 3*c*, among others, are possible. Alternatively, the packaging system may generally be designed to keep the payload above a desired temperature minimum or below a desired temperature maximum, as shown by upper temperature limit L1, which is a temperature maximum of about 12° C.

The first profile shown in FIG. 3*b*, denominated profile "A," represents a typical summertime inter-modal transport ambient temperature profile in an area with a relatively warm climate. At interval A1, the package may idle at warehouse temperature. At interval A2, the ambient temperature has increased during ground transportation to eventual loading on an aircraft. The temperature may decrease again at interval A3 during air transportation. The temperature may again increase at interval A4 as the package is offloaded from the aircraft, awaiting either a connecting flight or further ground transportation. This cycle may repeat several times until the package arrives at its ultimate destination. During the entire shipping process in these assumed warm weather conditions, a packaging system may be configured so as to maintain the payload temperature within the desired range R, or, alternatively, above/below a desired limit L.

The second profile shown in FIG. 3*b*, denominated profile "B," represents a typical wintertime inter-modal ambient temperature profile in an area with a relatively cold climate. At interval B1, the package may idle at warehouse temperature. At interval B2, the temperature has decreased during ground transportation prior to eventual loading on an aircraft. The temperature may decrease again at interval B3 during air transportation. The temperature may increase at interval B4 as the package is offloaded from the aircraft, awaiting either a connecting flight or further ground transportation. This cycle may repeat several times (i.e., B5) until the package arrives at its ultimate destination. Again, during the entire shipping process in these assumed cold weather conditions, a packaging system is configured so as to maintain the payload temperature within the desired range R.

With continued reference to FIGS. 1*a*, 1*c*, 2, and 3*a*, in a base configuration, the system components within the enclosure 110 may include six or more outer phase change elements 120, one positioned adjacent to each of the six walls of the enclosure. In contrast, in FIG. 1*b*, two or more semi-circular phase change elements may be provided to conform to the curvature of the cylindrically-shaped walls of the enclosure 110. Of course, it will be appreciated that phase change elements may be provided in various shapes or numbers to conform to the shape of the particular enclosure 110 employed. For example, in one embodiment, a plurality of smaller phase change elements could take the place of one larger phase change element, with the ability to add/remove one or more such smaller phase change elements to make incremental changes in the thermal capacity of the packaging system 100. Phase change elements, as will be discussed in greater detail below, include an enclosed phase change material in a defined shape, which may in some embodiments be a panel, brick, or curved shape, as desired. Flexible phase change elements, such as gels in flexible bags also may be used. The phase change elements 120 may be all the same size, or they may be different sizes. Providing smaller or larger element sizes may increase the number of packaging system configurations possible, and may thus increase modularity.

Phase change elements allow for thermal control of an environment by absorbing or releasing large amounts of thermal energy at a particular temperature, i.e., the temperature at which the phase change material changes phase from solid to liquid, or vice versa. The absorbed or released heat at this temperature is known as the latent (or hidden) heat, and varies from material to material. An example phase change element suitable for use with the present disclosure is described in co-pending patent application Ser. No. 12/902,863 entitled "Thermally Controlled Packaging Device and Method of Making," filed Oct. 12, 2010.

A base configuration may further include six or more inner phase change elements 140, adjacent to but separated from the outer phase change elements 120 by buffer inserts 130 and buffer pads 131 (buffer inserts 130 refer to the vertically oriented components shown in FIGS. 1*a*-1*c*, 2, and 3*a*, which provide separation between vertically oriented phase change elements, and, as will be described in greater detail below, may be modularly configurable with one another; buffer pads 131 refer to the horizontally oriented components shown in FIG. 1*c*, which provide separation between generally planar, horizontally oriented phase change elements, but, in some embodiments, are not modularly configurable with one another, or with the buffer inserts 130). The phase change elements 140 may be all the same size, or they may be different sizes. Furthermore, they may be provided in any shape suitable for the enclosure, as discussed above.

In one embodiment, the outer phase change elements may be provided with material in a first phase, while the inner phase change elements may be provided with material in a second phase. The two different phases (e.g., liquid and solid) allow the packaged article to be thermally controlled within a desired temperature range, the first and second phases providing the upper and lower bounds of the temperature range. The buffer inserts 130 and buffer pads 131 (FIG. 1*c*) may be provided to prevent direct physical contact between inner and outer phase change elements 140, 120, thus preventing direct conductive heat transfer therebetween that would exacerbate the loss of thermal control within the enclosure. In another embodiment, the outer phase change elements 120 may be provided in the same phase as the inner phase change elements 140. The single phase allows the packaged article to be thermally controlled above or below a desired temperature limit, the phase change temperature of the elements 120, 140 providing lower/upper limit. In this embodiment, the buffer inserts 130 and buffer pads 131 may be provided for structural support within the system 100, for example, to more easily provide and maintain a preferred orientation of phase change elements. This is particularly useful when phase change elements are flexible and not fully self-supporting.

Selection of the phase change materials may include consideration of multiple factors including, but not limited to, the desired protected temperature range, anticipated ambient temperatures during shipment, thermal properties of the different phase change materials, thermal properties of the container and/or insulation panels, and thermal properties of the temperature sensitive product being shipped. The design and sizing of phase change elements 120, 140 may vary depending on these factors as well. As will be appreciated, phase change elements 120, 140 may be provided in various sizes, shapes, and configurations, as will be discussed in greater detail below.

The packaged article 115 may be placed within a central portion of the enclosure 110, bounded directly by the inner phase change elements 140. The temperature sensitive payload can be wrapped, encased, or placed adjacent to the phase change elements 140. The access opening 111 may thereafter be closed, and the system 100 prepared for transportation.

As will be discussed in greater detail below with respect to each component of the thermally controlled system 100, various aspects of modularity of a set of container components may be provided to allow a number of system configurations in terms of payload size and thermal requirements, using a small number of standard, modular components. The set of container components is sized, to allow various packaging configurations with different thermal objectives formed by selection and combination from a set of modular phase change elements. The sizing of elements is designed to permit use in multiples, with predefined adjustability and interchangeability, where more or less of some thermal objective is to be achieved. In this manner, a variety of thermal control solutions are possible using a set of standard sizes and shapes of modular components, with various available thermal characteristics, thus reducing the lead time required to design and set up to manufacture new solutions for articles to be shipped in a wide variety of thermally controlled environments.

While the above-described base configuration may be suitable for some applications, it will be appreciated that modularity allows for the addition/subtraction of components, as wells as interchanging some components for others (for example, components of two different materials). For example, FIG. 3*d* shows a chart listing example desired payload sizes and payload temperature criteria of a modular packaging system 100 in accordance with the present disclosure. As shown, a variety of temperature ranges/limits are possible (<−15° C., 2-8° C., 15-30° C., etc.), and a variety of time-at-temperatures are possible (24 hours, 28 hours, 72 hours, 96 hours, etc.). Inherent in the concept of modularity, there may be a trade-off between the thermal capacity of the system and the payload size for any given enclosure size, as more phase change elements may be required for longer times-at-temperature (payload size is shown reduced from 8 liters to 5 liters for a 96 hour time-at-temperature). Furthermore, enclosures of different materials may be required for different temperature ranges/limits and durations (polyurethane (PUR) may be required where the desired temperature limit is extreme and for longer durations, i.e., below −15° C. for 96 hours, whereas expanded polystyrene (EPS) may be acceptable for other ranges). Therefore, as will be discussed in greater detail below, the selection/combination of the various components of the presently described modular packaging system and employment thereof in various configurations yields a wide range of packaging possibilities with a minimum number of required components, thereby allowing shipping solutions to be provided for novel applications in a minimum amount of time and at a minimal cost, because the modular element geometry remains standard.

Insulated Enclosure

In one embodiment, an insulated enclosure in accordance with the present disclosure may generally be configured in a six-sided, rectangular shape, as depicted in FIGS. 1*a*, 1*c*, 2 and 3*a* (insulated enclosure 110). However, it will be appreciated that other shapes of enclosure, such a cylindrical (FIG. 1*b*), triangular, trapezoidal, etc., are within the scope of the disclosure. The enclosure 110 may be configured with at least one access opening 111 along at least one side, or one part, of the enclosure 110. The access opening 111 may allow for insertion and removal of the packaged article 115, the phase change elements 120, 140, and the buffer inserts and buffer pads 130, 131, among other components. It may also facilitate sealing the outer enclosure to be substantially air tight either through close physical abutment with the enclosure 110 or, such as by, for example, a sealing means, such as an adhesive or tape.

The insulated enclosure 110 may generally be made of an insulative material of sufficient strength to maintain the integrity of the enclosure during shipment. As will be appreciated, a container may be dropped, jostled, or otherwise be subjected to blunt forces during shipment from the manufacturer to the end user, and thus the enclosure may be of a material designed to withstand such forces. Additionally, the enclosure 110 may be made of an insulative material to protect the thermally controlled environment within the enclosure from exterior temperatures that may vary greatly from the desired controlled environment, as discussed above with regards to FIGS. 3*b*, 3*c*. In one embodiment, the enclosure 110 is made of a material that is both sufficiently strong and sufficiently insulative for the desired shipping application. Such materials include cardboard or other corrugated paper-based materials, polyurethane, or expanded polystyrene, among others. In another embodiment, the enclosure 110 is made of two or more materials, one of each of such materials providing structural integrity and insulation. For example, cardboard and other corrugated paper-based materials, may provide strength and insulation for a variety of shipping applications. A layer of insulative foam, such as polyurethane, or expanded polystyrene, among others, may be added to this paper-based material to form a multi-layer enclosure. Other materials with the above-described qualities will be known to those having ordinary skill in the art, and are intended to be within the scope of the present disclosure.

A modular thermally controlled packaging system 100 in accordance with the present disclosure may be provided with a single size of enclosure 110 that may be used for a variety of shipping applications. The interior configuration of the system 100 (phase change elements, buffer inserts) would then be variously configured to allow for different sized articles with different thermal control requirements. By using a single size of enclosure 110, the simplicity of the modularity of the system is greatly increased by the need to stock only a single configuration of enclosure, thus reducing the total number of parts required to create a modular thermally controlled system.

In alternative embodiments, a set of modular container components may include enclosures 110 of two or more sizes, geometric configurations, or structural/insulating materials. The sizes, geometric configurations, and materials may be coordinated with the other components listed below.

Phase Change Element

A phase change material is a substance with a high latent heat of fusion which, melting and solidifying at certain temperatures, is capable of storing or releasing large amounts of energy. Initially, solid-liquid phase change materials perform like conventional heat storage materials; their temperature rises as they absorb heat. Unlike conventional heat storage materials, however, when phase change materials reach a phase change temperature, i.e., melting point, they absorb large amounts of heat without a significant rise in temperature. When the ambient temperature around a liquid material falls, the phase change material cools and solidifies, releasing its stored latent heat. Certain phase change materials store 5 to 14 times more heat per unit volume than conventional heat storage materials such as iron, masonry, or rock. Embodiments of the presently disclosed packaging system 100 employing phase change materials in standard modular elements may protect the payload from ambient temperatures that are both colder and hotter than the desired payload protection temperature range.

A phase change element used with the present disclosure, as shown in various modular configuration is FIGS. 4*a*-4*f*, may include a foam material having low weight and high absorbency, a phase change material, and a protective covering, as described in patent application Ser. No. 12/902,863. A predetermined amount of phase change material may be absorbed into the foam material, and the protective covering may surround the foam material and may be vacuum sealed to maintain a predetermined shape of the foam material and to prevent any of the phase change material from leaking out of the foam material. In alternative embodiments, the phase change element may include a liquid, gel, or other hydrocolloid material enclosed within a protective covering, as shown in FIG. 4*g*. The phase change element may take the form of a three-dimensional rectangular or "brick" shape, as in FIGS. 4*a*-4*f*, although other three-dimensional shapes are possible for special packaging applications which may require other shapes. For example, the phase change elements of FIG. 4*g* are configured in a series of generally rectangular compartments.

FIGS. 4*a*-4*b* depict the shape and relative dimensions of a phase change element in a series of variously sized three-dimensional rectangular or brick shapes 205, which may be formed from a single phase change element platform 200. As shown, the phase change brick 205 has a length and a width which may be of any dimension, and a depth which is significantly less than the length or width. A top face of the phase change brick 205 may have a cover film 206 (FIG. 40 which extends laterally beyond the dimensions of the length and width of the rest of the brick 205.

Figure 4F:
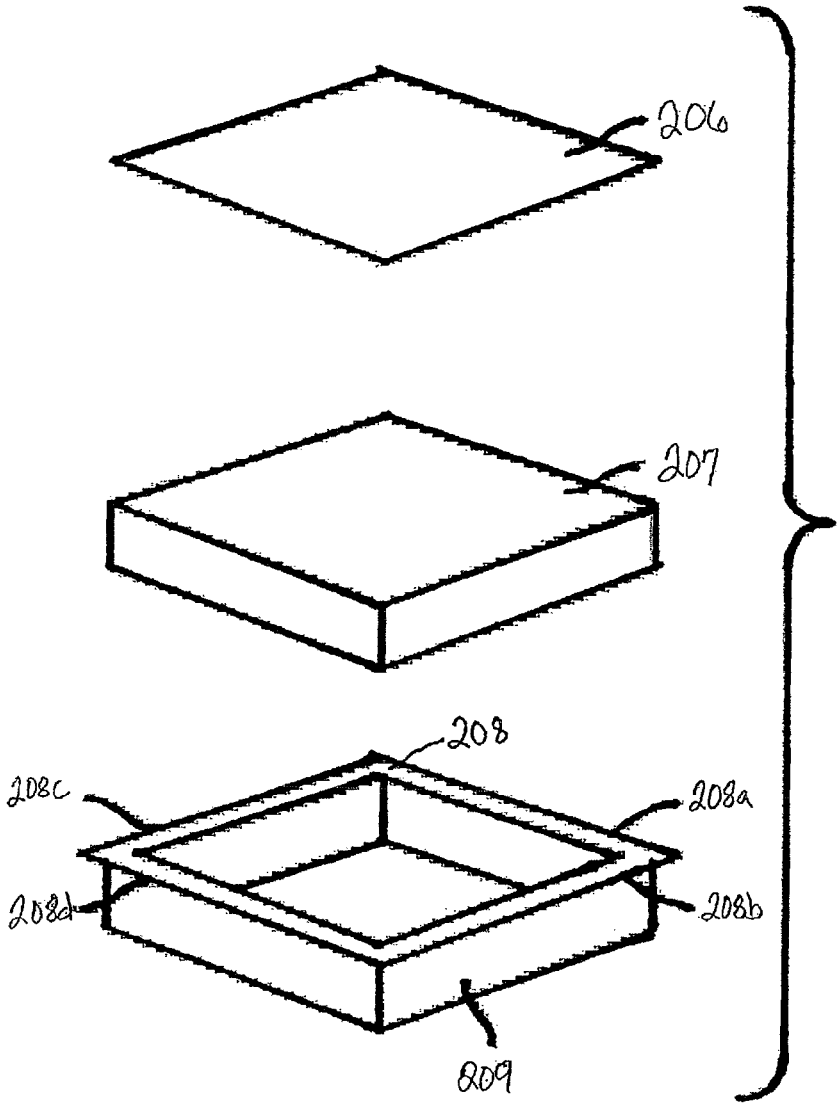
FIG. 4*f* shows a deconstructed view of a modular phase change element as in FIGS. 4*a*-4*e*.
Figure 4G:
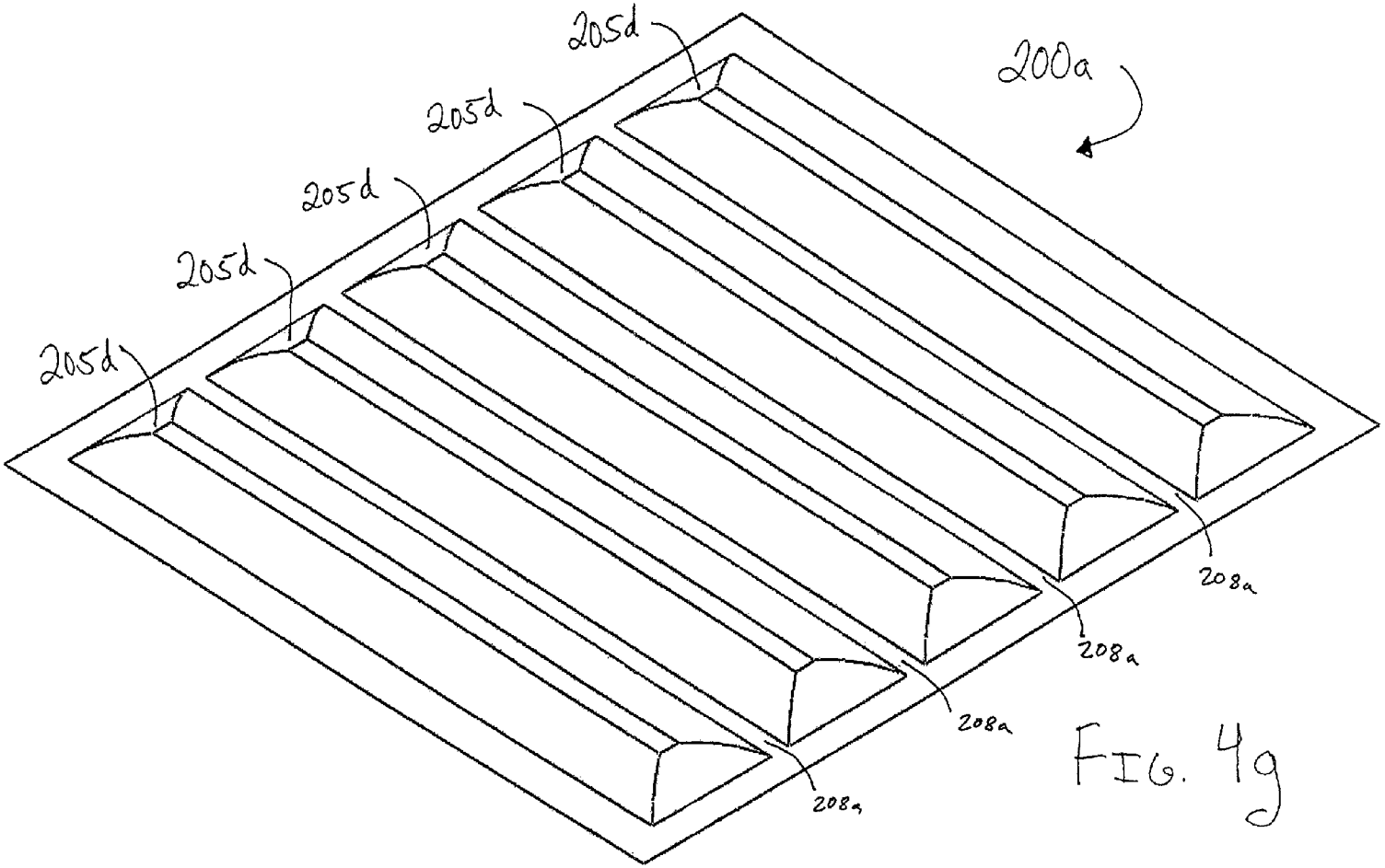
FIG. 4*g* shows an alternative modular phase change element as used with the present disclosure.

The general construction of one type of phase change element in accordance with the present disclosure is depicted in FIG. 4*f*. A bottom film 209 may be provided, formed to have a base and four sides extending generally perpendicularly from the base. Four sealing edges 208*a*-208*d* may also be provided extending generally perpendicularly from the sides (or in a plane generally parallel to the plane of the base). A block of foam material 207 (with phase change material absorbed therein) may be provided having dimensions such that it fits substantially filling the volume defined by the base and sides of the bottom film 209. A cover film 206 may be provided having dimensions such that it covers the foam material and mates with the sealing edges 208*a*-208*d* of the bottom film 209.

A fully constructed phase change element 205 may have the foam material 207 (with phase change material absorbed therein) inserted within the volume defined by the bottom film 209, and the top film 206 sealed along the sealing edges 208*a*-208*d* of the bottom film to fully cover and enclose the foam material 207.

A foam material or means for absorbing suitable for use with the present disclosure may be made using many suitable polymeric materials that can be formed into a foam, such as polyurethanes, polystyrenes, phenol derivatives, and other materials as will be known to those skilled in the art. Such foam materials or means for absorbing may be similar to those used for water-holding floral foam, including certain phenolic foams. Phenolic foams in accordance with the present disclosure may include phenol-aldehyde resol resins. Such resol resins may be prepared by reacting one or more phenols with an excess of one or more aldehydes in an aqueous phase and in the presence of an alkaline catalyst.

In the alternative embodiment of FIG. 4*g*, phase change elements are defined by a phase change element platform 200*a* having a plurality of separated phase change material containing segments 205*d* (no foam or other substrate being provided within the segments). These segments 205*d* are separated by linear voids 208*a*. Voids 208*a* may be defined during a thermal bonding manufacturing process. For example, the voids 208*a* and segments 205*d* may be formed from a pair of thermoplastic sheet material brought together during a thermal bonding/filling process. Voids 208*a* may be continuous, that is to say each segment 205*d* is separated from one other and the phase change material encased therein is prevented from flowing from one segment 205*d* to an adjacent segment 205*d*. In another embodiment, voids 208*a* may be non-continuous and phase change material may be able to flow from one segment 205*d* into another segment 205*d* when an external force is supplied. Thus, the interior volumes of segments 205*d* may be either separated or provided in fluid communication with each other.

Referring now particularly to the phase change material, suitable materials for use with the disclosed device may include both organic and inorganic materials, including water and other liquids, salts, hydrated salts, fatty acids, paraffins, mixtures thereof, gels and other hydrocolloids (dispersed solid phase material suspended within a liquid water phase) or other materials or means for changing phases as will be known to those skilled in the art. Because different phase change materials or means for changing phases undergo phase change (or fusion) at various temperatures, the particular material that is chosen for use in the device may depend on the temperature at which the packaging payload is desired to be kept, which may include ranges between approximately −50 and +40 degrees Celsius. The particular range of temperatures is defined on the high end by the temperature at which a solid phase change material changes phase into a liquid, and on the low end by the temperature at which a liquid phase change material changes phase in to a solid. As shown in FIG. 3*c*, phase change materials may be selected so as to keep the payload at any desired range of temperatures, for example, but not limited to R1 (about 15 to 22° C.), R2 (about (about 2 to 8° C.), and R3 (about −6 to −8° C.).

Other phase change materials or means for changing phases useable in the present device may include compositions produced in accordance with the process as described in U.S. Pat. No. 6,574,971, that have the desired phase change temperature and viscosity characteristics. With regard to the embodiment of FIGS. 4*a*-4*f*, the phase change material must also have the ability to be absorbed into the foam materials or other means for absorbing that are described above. The materials of U.S. Pat. No. 6,574,971 include fatty acids and fatty acid derivatives made by heating and catalytic reactions, cooling, separating and recirculating steps as more fully described in U.S. Pat. No. 6,574,971. The reactant materials include a fatty acid glyceride selected from the group consisting of oils or fats derived from soybean, palm, coconut, sunflower, rapeseed, cottonseed, linseed, caster, peanut, olive, safflower, evening primrose, borage, carboseed, animal tallows and fats, animal greases, and mixtures thereof. In accordance with the processes of U.S. Pat. No. 6,574,971 the reaction mixture is a mixture of fatty acid glycerides that have different melting points and the reaction is an interesterification reaction, or the reaction mixture includes hydrogen and the reaction is hydrogenation, or the reaction mixture is a mixture of fatty acid glycerides and simple alcohols and the reaction is an alcoholysis reaction. The ability of the process of this patent to achieve materials with a wide variety of targeted phase change temperatures, permits phase change elements of standard sizes/shapes, as in the modular component sets described herein, to have functional performance characteristics that are different. Thus, a variety thermal performance options are achievable with a modular set of geometrically standardized components.

In further embodiments, phase change elements other than those that change phase from liquid to solid may be employed. For example, dry ice (solid carbon dioxide) is a commonly used phase change element. Dry ice sublimates (changes phase from solid to gas) at atmospheric pressure and at temperatures above −56.4° C., and is thus useful in applications where a low temperature limit is desired. Dry ice may be provided in block or pellet form, and positioned securely within the container as will be described below with regard to the buffer inserts. It will be appreciated that because dry ice sublimates, its volume greatly expands as it changes phase. Thus, no outer covering, as with the phase change element embodiments described above, would be employed. Rather, as the dry ice changes phase, its solid volume reduces within the container. However, with the buffer inserts provided as structural support, the structural integrity of the container is not an issue, even if the dry ice were to completely disappear during shipping.

It will be appreciated that phase change elements in accordance with the present disclosure may be designed so as to keep a packaged product at a temperature below the ambient or at a temperature above the ambient. In uses where the phase change element is intended to keep the packaged product below the ambient, the device will be provided with the phase change material in solid phase (cooled below its phase change temperature). In use, in an ambient cold environment, the element will absorb heat, and change phase to liquid, while maintaining the constant temperature as desired. In uses where the phase change element is intended to keep the packaged product above the ambient, the element will be provided with the phase change material in liquid phase (heated above its phase change temperature). In use, the element will give off heat, and change phase to solid, while maintaining the constant temperature as desired. It will also be appreciated that a combination of solid and liquid state phase change elements may be provided in applications where a defined temperature range is required.

Phase change elements may be provided in different sizes in order to facilitate modular configurations of the system 100. From a single size phase change element platform 200, 200*a*, various numbers and sizes of phase change elements are possible. For example, FIG. 4*c* depicts a representation of a single brick-shaped phase change element 205*a* in a three-dimensional rectangular shape. In essence, this single phase change element 205*a* may be made from an undivided phase change element base platform 200. FIG. 4*d* depicts a representation of two phase change elements 205*b* of equal size formed by partitioning the base platform 200, while FIG. 4*e* depicts a representation of four phase change elements 205*c* of equal size formed by partitioning the base platform 200. Furthermore, in FIG. 4*g*, five phase change elements 205*d* of the alternative configuration described above may be formed from the platform 200*a*. Other sizes of phase change elements may similarly be formed by partitioning the single platform 200, 200*a*. In this manner, various modular sizes of phase change element 205, 205*a* may be formed from a single base platform 200, 200*a*, allowing for greater configurability of the system 100 to adapt to different size and thermal control requirements of the packaged article.

Phase change elements may also be provided in different thicknesses in order to facilitate modular configurations of the system 100. Thus, platforms of various thickness may thus be employed, as described above, to form phase change elements in multiple configurations. With this in mind, a further comment is necessary regarding the Figures provided in the present disclosure. In the Figures, phase change elements are depicted in one or more layers. However, because various thicknesses of phase change element are possible, the layered depiction in the Figures could also be a single layer of a thicker phase change element, rather than multiple layers of a single thickness phase change element.

Buffer Inserts

In one embodiment, a thermally controlled packaging system in accordance with the present disclosure may include one or more buffer inserts 130 and one or more buffer pads 131. As previously discussed above with regard to FIGS. 1*a*-1*c*, 2, and 3*a*, the buffer inserts 130 may be positioned between adjacent sets of vertically oriented phase change elements so as to prevent direct contact between such phase change elements. Buffer pads 131 may be provided in a like manner for the adjacent sets of horizontally oriented phase change elements. For example, it may be undesirable for a phase change element in the solid phase to come into direct contact with a phase change element in the liquid phase, as such contact may exacerbate phase change in the phase change material through conductive heat transfer, causing the phase change elements to be effective for a lesser period of time.

Buffer inserts and buffer pads in accordance with the present disclosure are preferably made from panels of an insulative material so as to best prevent or reduce conductive heat transfer between adjacent phase change elements. Such materials may include corrugated paper materials, such as cardboard, low conductivity polymers, such a polypropylene or polyethylene, fiberglass, or other insulative materials as will be known to those of ordinary skill in the art. Buffer inserts and buffer pads may also preferably be formed from a structurally rigid material so as to provide structural support within the packaging system 100 during transportation, for example, to keep the phase change elements in optimal positions within the enclosure. In particular, in modular configurations of the system wherein a single phase of phase change element is employed (i.e., where the payload is to be maintained above or below a temperature limit), the buffer inserts and buffer pads may primarily serve the function of structural support, as there would be no need for insulation between phase change elements of the same phase.

Buffer inserts and buffer pads may generally be sized in accordance with the enclosure for which they are designed to be used. For example, with regard to the panel length and width dimensions, buffer inserts and buffer pads may generally be sized slightly smaller than the side dimensions of the enclosure to allow for easy insertion into the enclosure, and to account for the fact that the buffer inserts and buffer pads may be placed somewhat inwardly from the side walls of the enclosure to allow room for the outer phase change elements, as shown in FIGS. 1*a*-1*c*, 2, and 3*a*. The thickness of the buffer inserts and buffer pads may generally be relatively thin with regard to the thickness or the phase change elements to allow for optimal interior space within the disclosure, but any thickness in the range from 0.1 inches to 3, 4, 5, 6 or more inches is contemplated within the scope of the disclosure. In particular, relatively thicker buffer inserts and pads may be employed where insulative properties are desired (i.e., two phases of phase change elements present within the system), whereas relatively thinner buffer inserts and pads may be employer where only structural properties are desired (i.e., only a single phase of phase change elements present within the system).

Figure 5A:
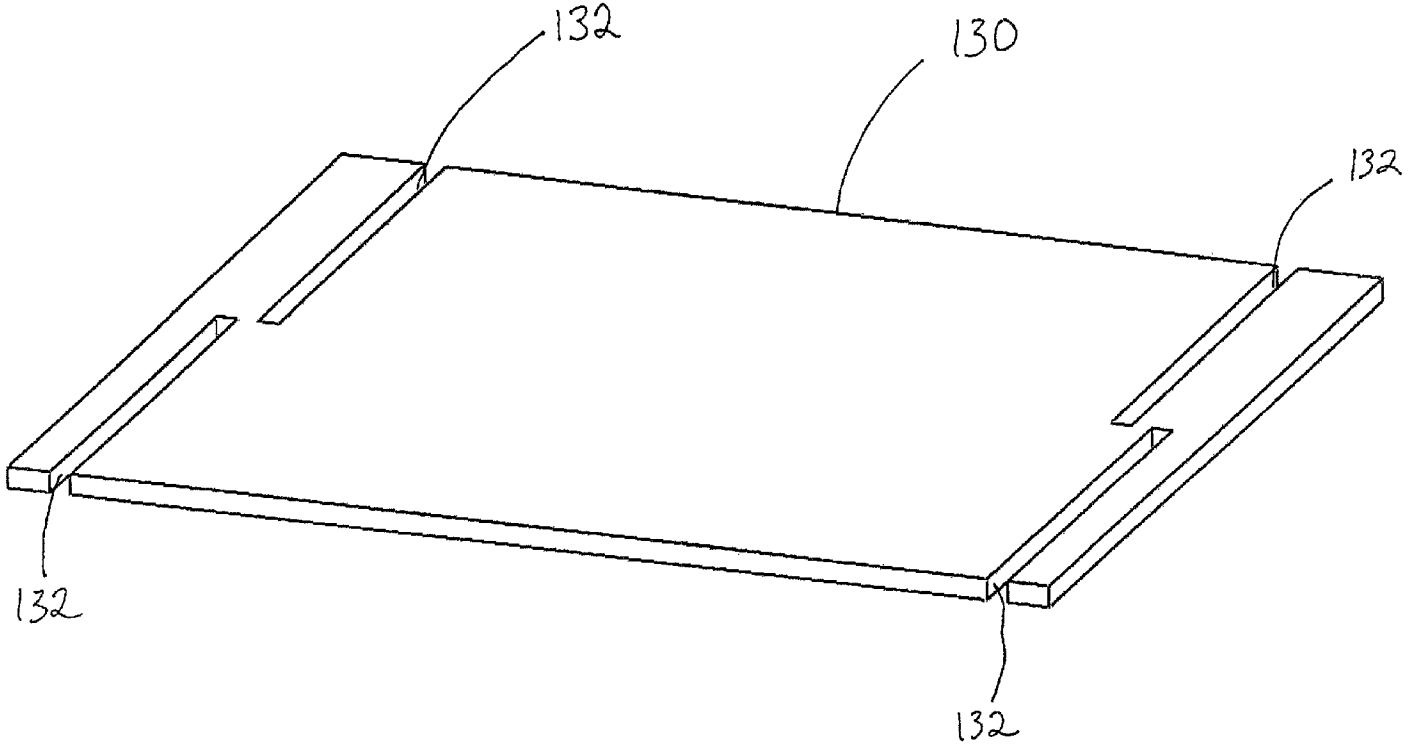
FIGS. 5*a*-5*c* show a modular buffer insert elements as used with the present disclosure.
Figure 5B:
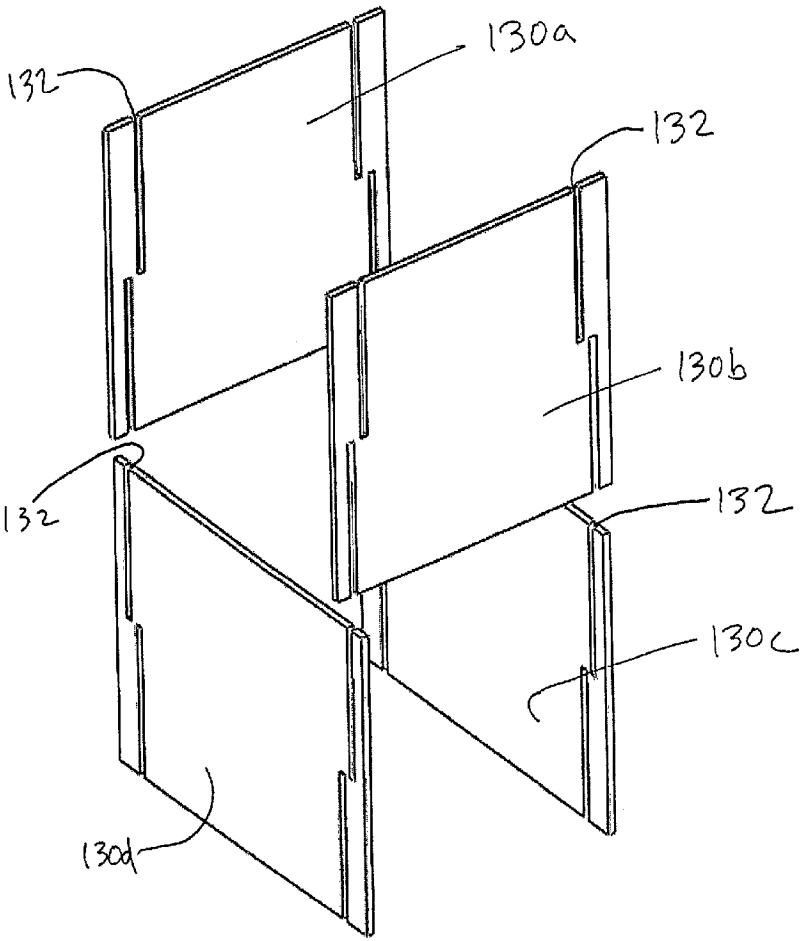
Figure 5C:
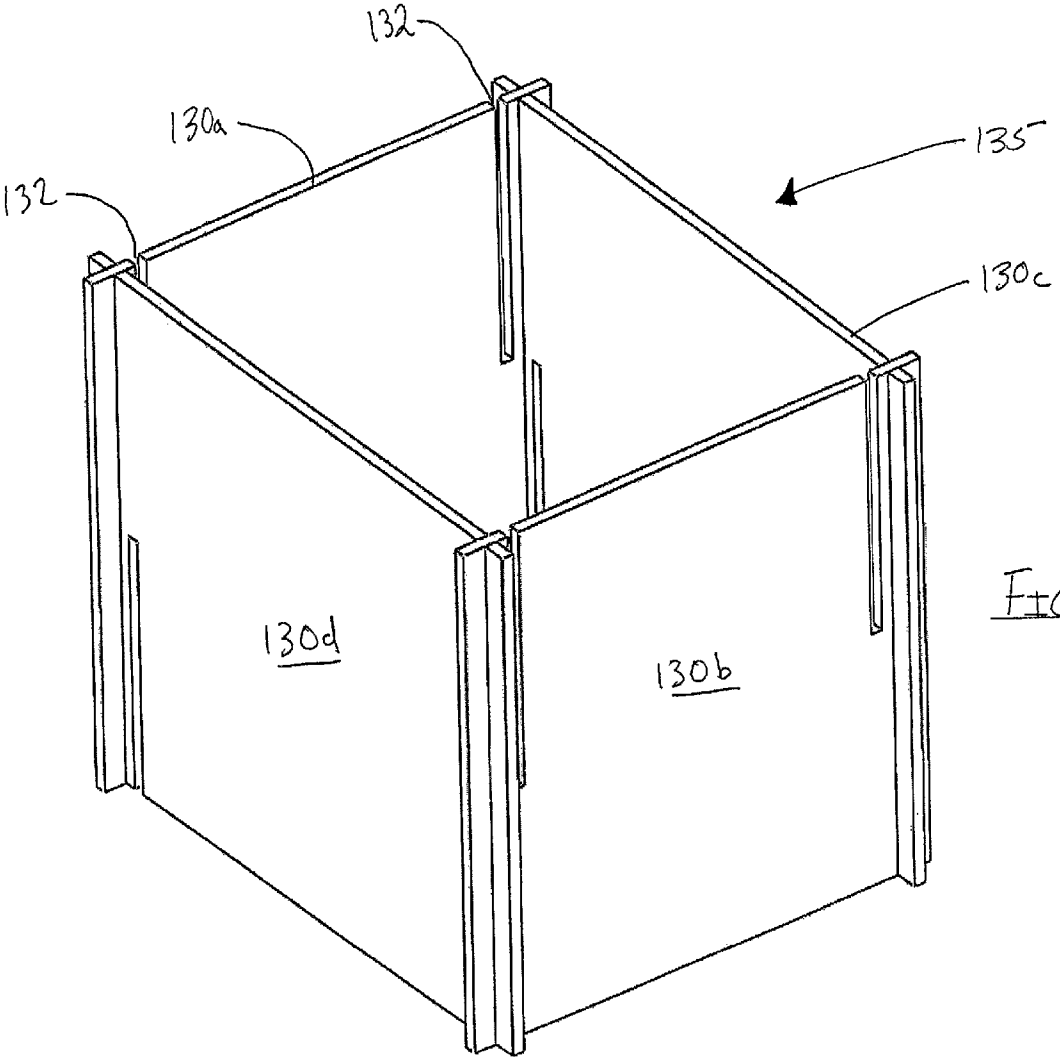

With reference now to FIGS. 5*a*-5*c*, the assembly of a modular, four-sided buffer insert configuration 135 is shown. FIG. 5*a* shows a single panel buffer insert 130 with modular adaptations 132. Modular adaptations 132 generally refer to any means by which buffer inserts may be made to selectively interact or interconnect with one another so as to provide modular structural support and thermal insulation within the modular packaging system 100. The modular adaptations 132 in the embodiment of FIGS. 5*a*-5*c* are in the form of opposing pairs of thin cut-outs from the panel, located on lateral edges of the panel and extending inward therefrom half the length of the panel, to allow for two or more panels to be interlocked with one another at multiple positions along the panel. In this manner, the buffer inserts are selectively configurable at various sizes to accommodate various sized articles to be packaged within the thermally controlled packaging system.

FIG. 5*b* shows the assembly of four buffer insert panels 130*a*-130*d*, to be interlocked at selected modular adaptations 132 to form a selected size of buffer insert configuration 135. FIG. 5*c* shows the completed buffer insert configuration 135 in a rectangular form, adapted to receive four pairs of inner and outer phase change elements on opposite sides of each respective panels 130*a*-130*d*, and sized to lit within a desired enclosure and around a desired article.

To change the size of a buffer insert configuration as in FIG. 5*c*, a user may simply interlock the panels at one of several alternatively positioned modular adaptations 132 on the buffer insert panels 130*a*-130*d*. In this manner, a variety of sizes of buffer insert configurations 135 may be created from a single size of buffer insert panel 130 having various modular adaptations 132.

Figure 5D:
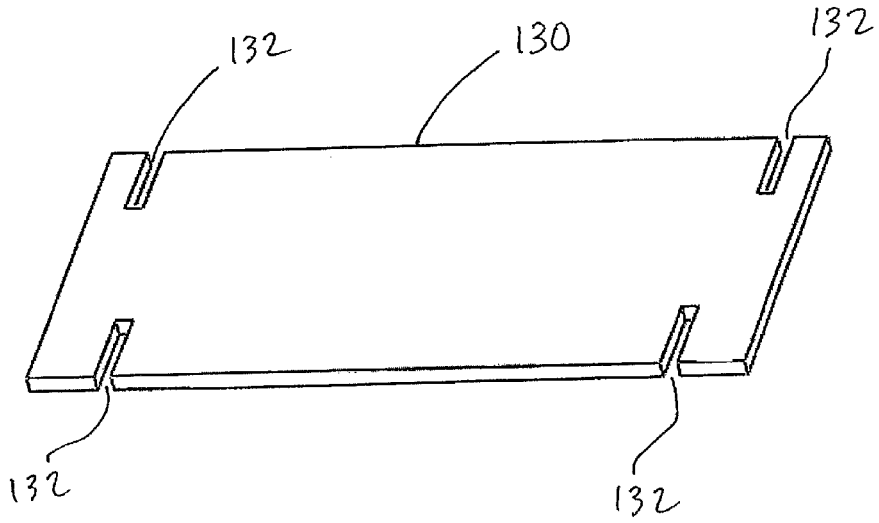
FIGS. 5*d*-5*f* show an alternative modular buffer insert elements as used with the present disclosure.
Figure 5E:
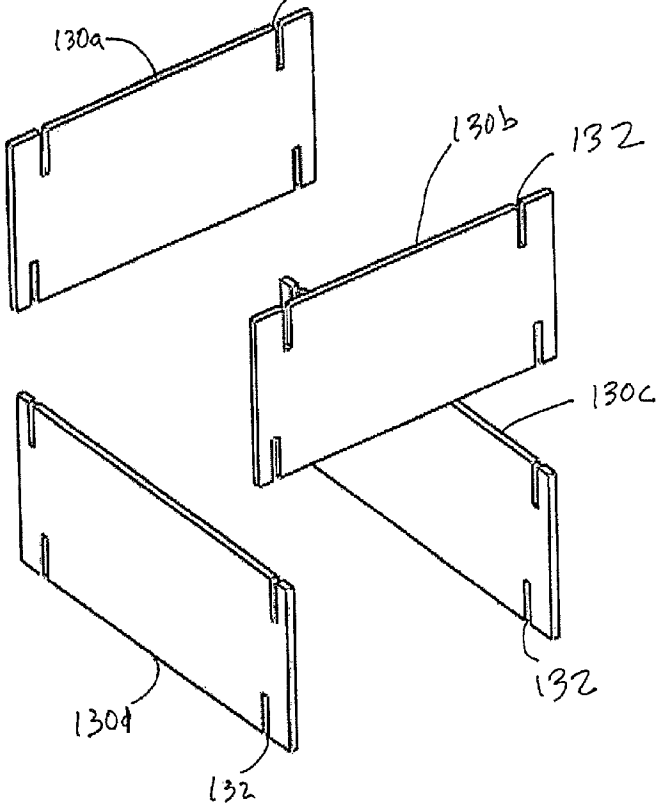
Figure 5F:
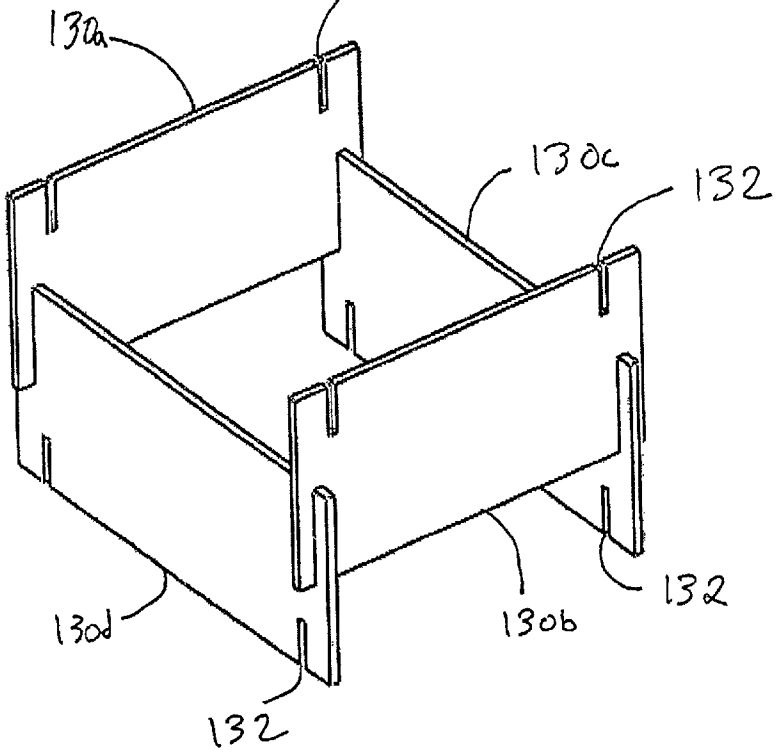

FIGS. 5*d*-5*f* depict a similar buffer insert configuration as in FIGS. 5*a*-5*c*, except that the modular adaptation cut-outs 132 are only made to extend a quarter of the length of the panel inwards from it lateral edges, as shown. In this alternative embodiment, adjacent buffer inserts 130*a*, 130*b*, 130*c*, and 130 are offset from one another half of a panel length, as the shortened cut-outs 132 do not allow one panel 130 to be fully inserted over another.

Of course, modular adaptations in accordance with the present disclosure are not limited to the interlocking cut-outs as shown in the representative embodiments of FIGS. 5*a*-5*f*. For example, buffer inserts may be made to selectively interact or interconnect with one another in any known means, such as fastening means (i.e., Velcro™, screws, locks, joints, rivets, and other connectors, etc.), adhesions means (i.e., glue, tape, and other adhesives, etc.), and physical adjoining means (i.e., interlocking channels, plugs, cut-outs, and other mating configurations, etc.), among others.

As will be appreciated, buffer inserts, when placed within a container, define two volumes. The first (outer) volume is between the container walls and the buffer insert, and the second (inner) volume is between the enclosed article and the buffer insert. Outer phase change elements are designed to be placed within the first volume, and inner phase change elements within the second volume. When buffer inserts are modularly adjusted outward (i.e., configured so as to have a larger perimeter), the first volume is reduced while the second volume is increased. Conversely, when buffer inserts are modularly adjusted inward (i.e., configured so as to have a smaller perimeter), the first volume is increased while the second volume is reduced. This configurability allows the buffer inserts to provide precise structurally defined volumes for the phase change elements, such that only enough space is provided for each respective volume to allow the required amount of phase change material to be inserted therein, thereby substantially eliminating "dead space" within the container, which, if not eliminated, would not only result in a less structurally sound container (as phase change elements might jostle about their unfilled volume during shipping), but also result in less than optimal thermal properties as circulating air within the container may cause a loss of thermal capacity. In essence, the buffer inserts allow the user to shift the distribution of volume within the container to best meet the desired thermal properties and to reduce the conductive heat-flow occurring in air spaces.

Centering Ring

Figure 6:
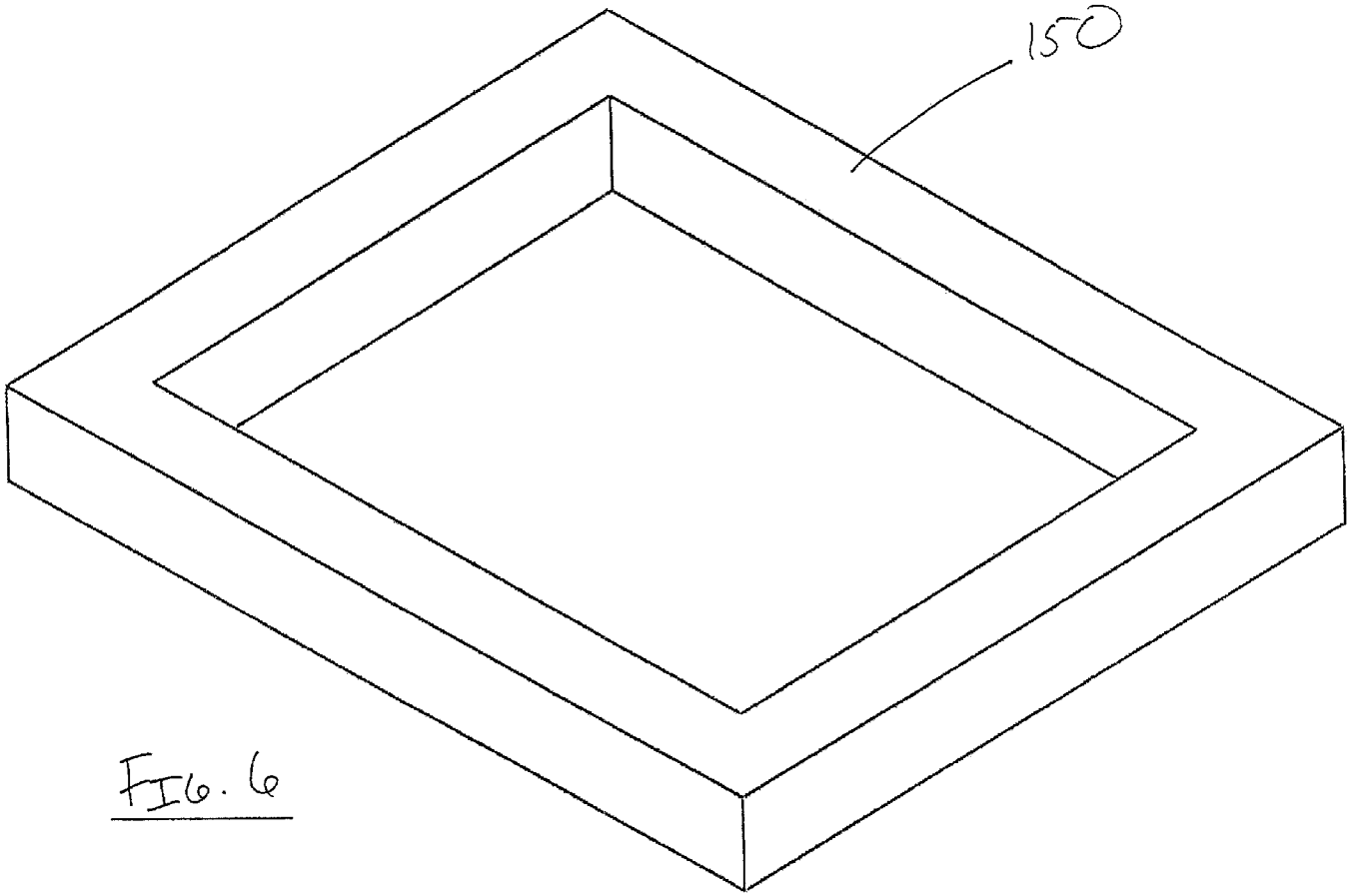
FIG. 6 shows a modular centering ring as used with the present disclosure.

In one embodiment of the presently disclosed modular thermally controlled packaging system 100, a centering ring 150, as shown in FIG. 6, may be provided to support the phase change elements along a central location with regard to the article 115 during shipping. As will be appreciated, a particular problem with existing systems is that they are not configured for optimal thermal control if the orientation of the package is changed during shipping. During transport, packages are often rotated, repositioned, or otherwise cause to be put in a different orientation than when the system was configured for shipping. Thus, existing systems suffer from the drawbacks that the phase change elements of the articles may shift positions during transport so that they are no longer centered on the payload face to which they are arranged, causing them to lose their optimal configuration for thermal control.

Figure 7A:
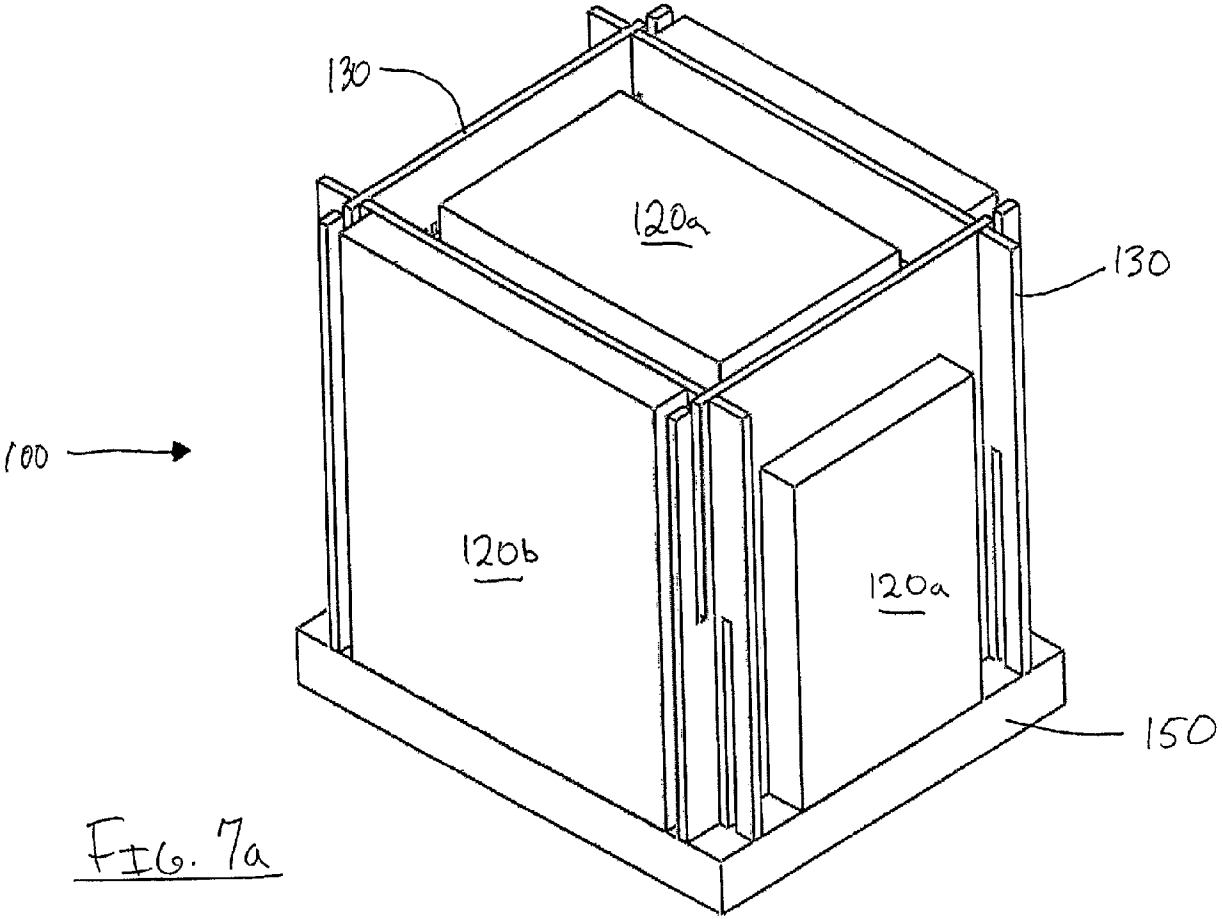
Figure 7B:
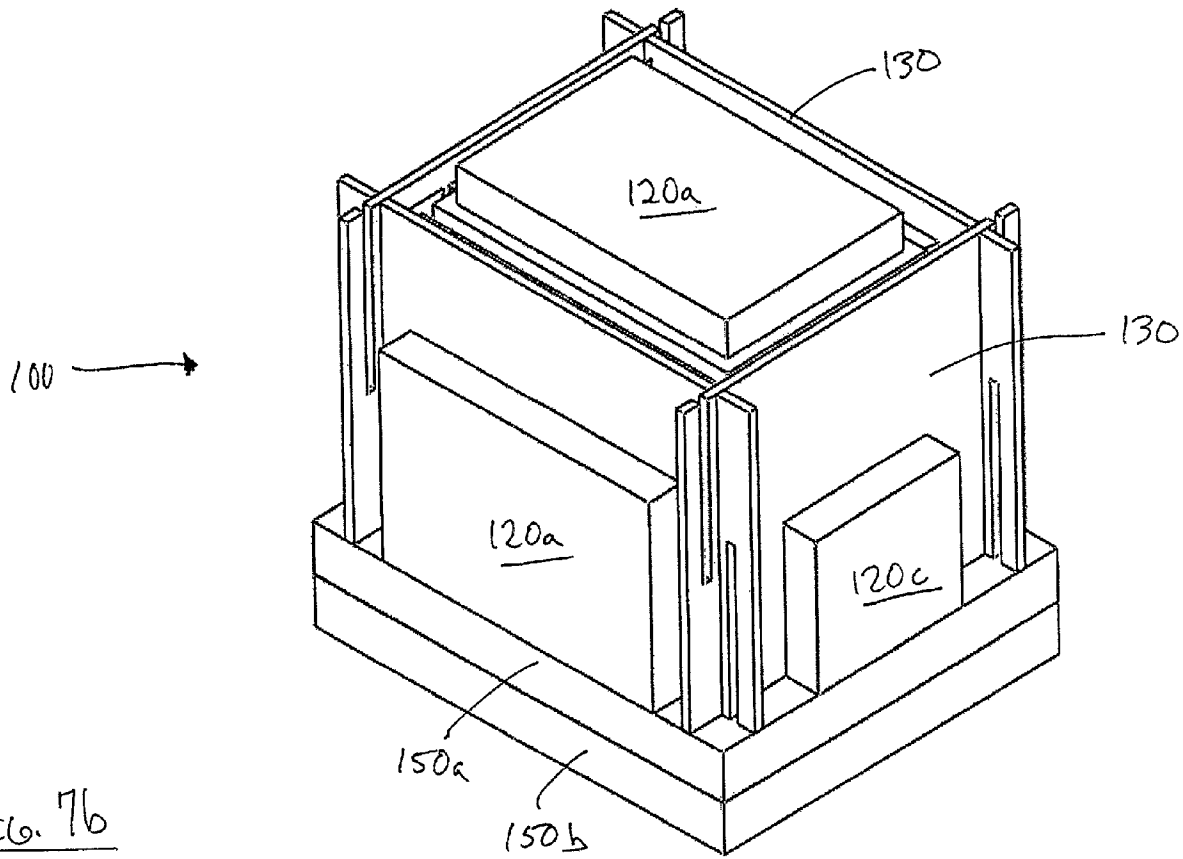
Figure 17C:
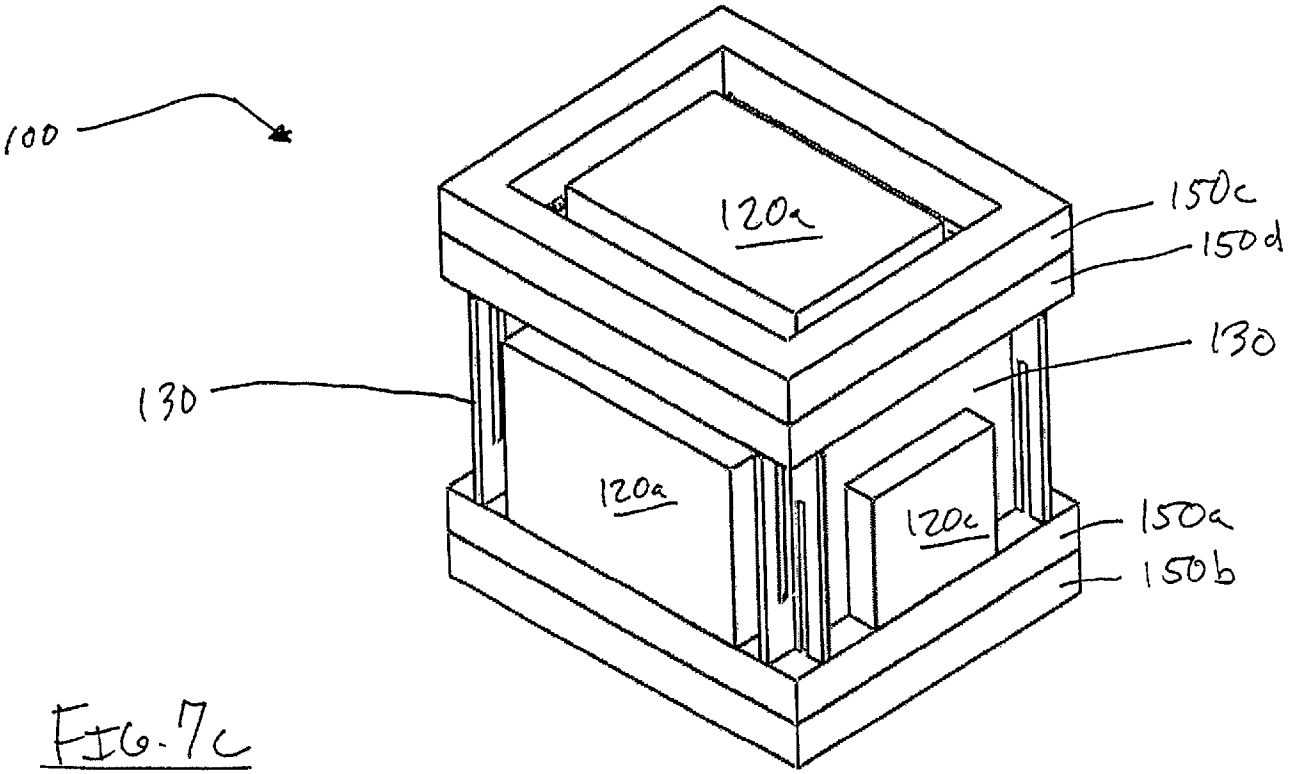

As shown in FIGS. 7*a*-7*c*, one or more centering rings 150 (150*a*, 150*b* in FIGS. 7*b* and 150*a*-150*d* in FIG. 7*c*) may be provided to securely and centrally position the phase change elements 120, 140 about the article 115. The centering rings 150 may serve to prevent the phase change element from moving from their central and optimal positions with regard to the article 115 during transport if the orientation of the package is changed.

Furthermore, as depicted particularly in FIG. 7*b*, the centering rings 150*a*, 150*b* provide a level of modularity in that various sizes of phase change element 120, 140 may be used within a single size enclosure 110, and still be maintained at a more optimal, generally side-centered position with regard to the article 115. As shown, a relatively smaller outer phase change element 120 is supported centrally within the packaging system by two centering rings 150*a*, 150*b*, as compared to FIG. 7*a*, where a relatively larger phase change element 120 is supported by a single centering ring 150. Furthermore, in FIG. 7*c*, two additional centering rings 150*c*, 150*d* are provided to maintain this optimal position, even if the orientation of the package is changed during shipping. In this manner, various configurations of phase change elements providing a variety of thermal control levels can be employed optimally within a single enclosure 110.

Centering rings 150 can generally be configured as an open rectangular ring to conform to the size of the enclosure. The open area may allow for the positioning of additional phase change elements therewithin, if desired. Further, the centering rings 150 may be relatively thin to allow for numerous modular configurations by stacking two or more rings. The rings 150 may generally be made of any material, although a material that is both strong enough to support the phase change elements, and light weight to reduce overall packaging weight, such as cardboard or expanded polystyrene, would be preferred. Of course, any shape or configuration of centering ring 150, made with any material, is considered to be within the scope of the present disclosure.

As previously mentioned, centering rings 150 may be provided on only one side of the packaging, as depicted in FIGS. 7*a* and 7*b*, or they may be provided on multiple sides of the packaging, as in FIG. 7*c* (showing additional centering rings 150*c* and 150*d*), to maintain the phase change elements in a desired central position even if the packaging changes from its initial orientation during shipping.

Modular Configurations

As shown in the example configurations of FIGS. 8*a*-8*b* and 9*a*-9*b*, the modular components of the presently disclosed thermally controlled packaging system 100 allow for a great variety of sizes of articles to be shipped under a great variety of thermally controlled conditions. In this manner, the presently disclosed system 100 is adaptable to a variety of uses with a minimal number of components.

Figure 8A:
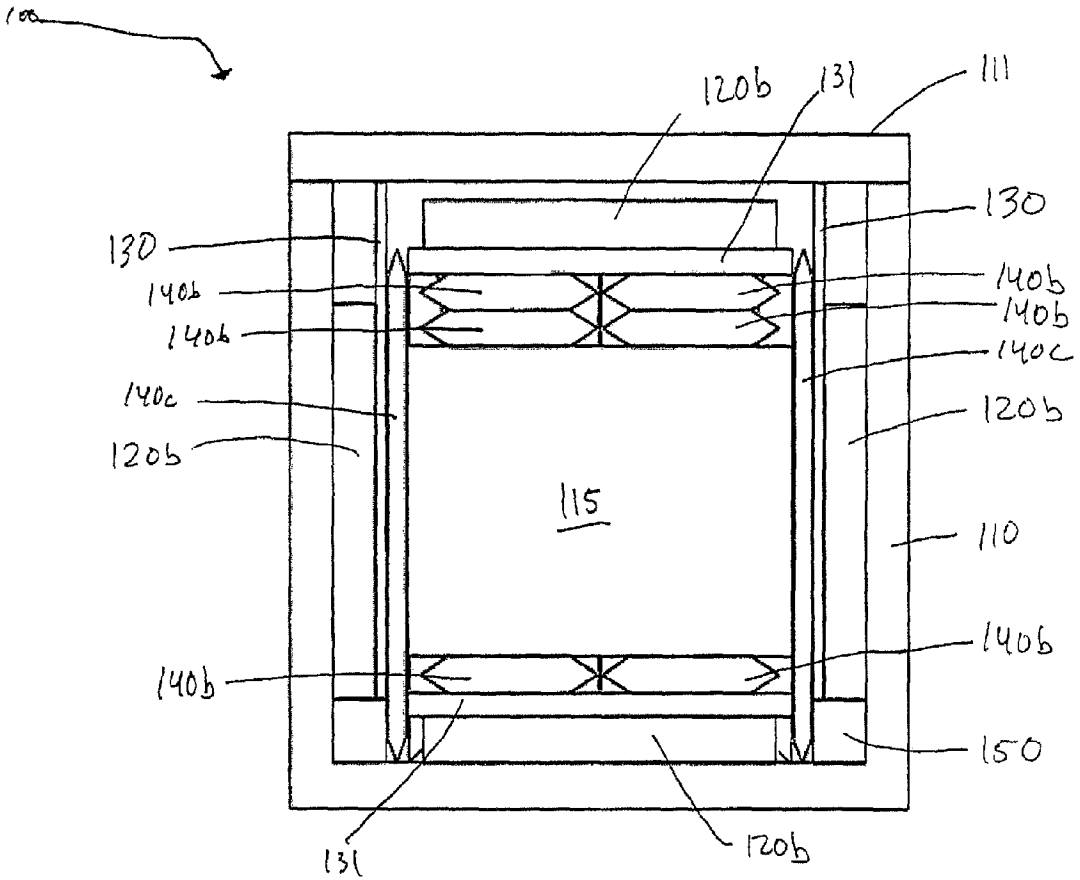
FIGS. 8*a*-8*b* show cross-sectional side views of two configurations for modular use of a thermally controlled packaging system in accordance with the present disclosure.
Figure 8B:
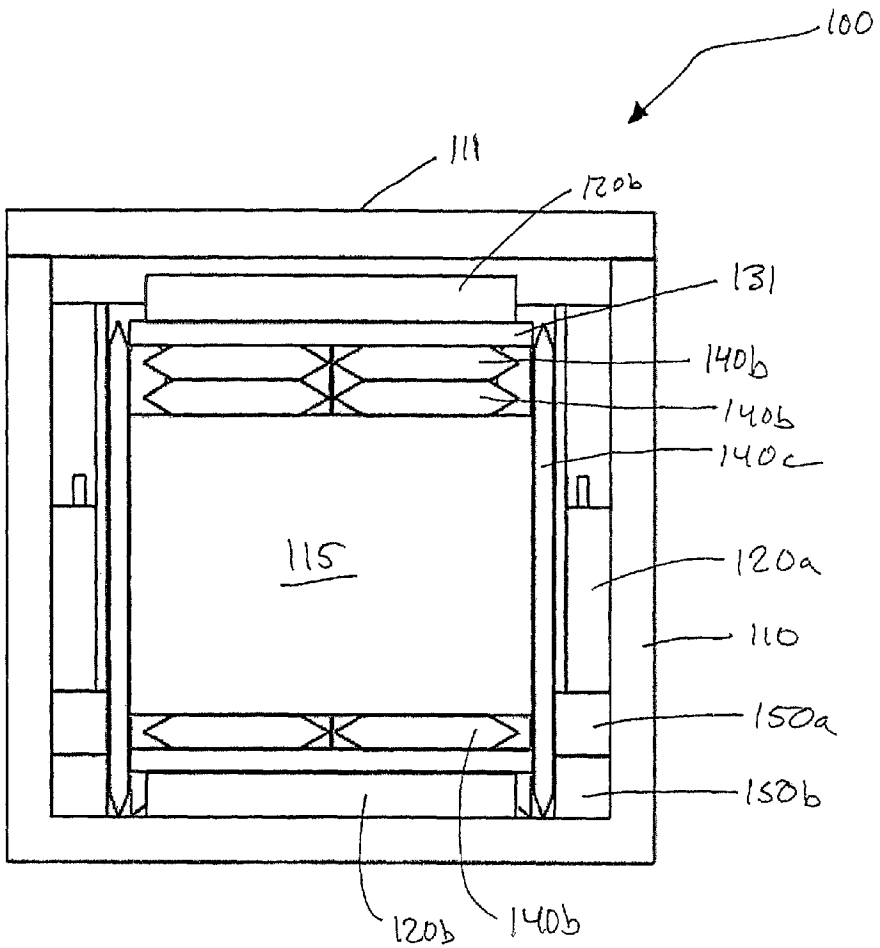

In one example, FIGS. 8*a*-8*b* contrast the configurations of two thermally controlled systems 100 with two different thermal requirements. In FIG. 8*a*, a first (relatively larger) size of outer phase change element 120*b* is employed for the vertically oriented side walls of the enclosure. In FIG. 8*b*, in contrast, a relatively smaller, second size of outer phase change element 120*a* is employed. (The inner phase change elements 140*b*, 140*c* are the same in both configurations). Thus, in FIG. 8*a*, only a single centering ring 150 is employed, whereas in FIG. 8*b*, two centering rings 150*a*, 150*b* are employed to maintain the relatively smaller phases change devices 120*a* in the more optimal, generally side-centered position with respect to the packaged article 115. Thus, with all other things being constant, two packaging systems with two different thermal capacities (FIG. 8*a* having a larger thermal capacity than FIG. 8*b* due to the larger phase change elements 120*b*) are easily configurable within the same enclosure using the modular components described herein. As discussed above, thermal capacity relates directly to the time interval during which the packaging is able to maintain the payload within the temperature range, as heat is absorbed/released over time from the phase change elements. In this manner, the time-at-temperature can be adjusted by selecting different sizes/numbers of phase change elements. Cost savings can be achieved by only providing enough thermal capacity (i.e., number and size of phase change elements) to ensure that the payload arrives at a desired temperature within a predetermined period of time, for example, 24, 48, 72, 96, or 120 hours.

Figure 9A:
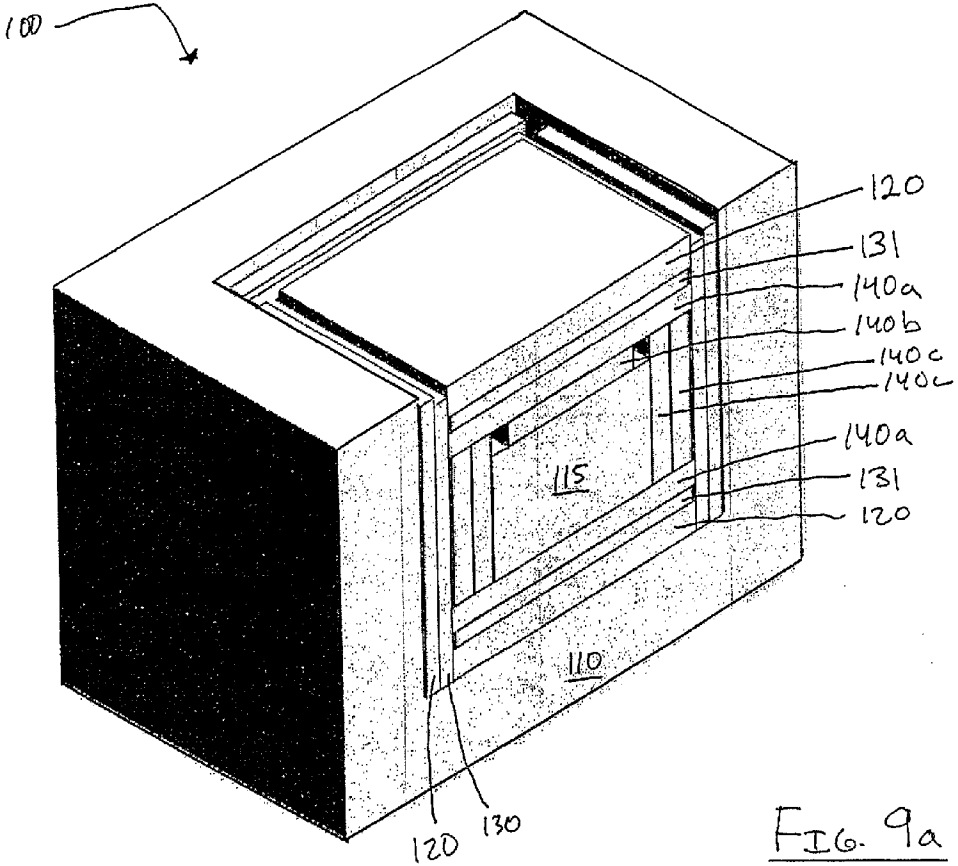
FIGS. 9*a*-9*b* show cross-sectional views of two additional configurations of a thermally controlled packaging system using modular PCM elements in accordance with the present disclosure.
Figure 9B:
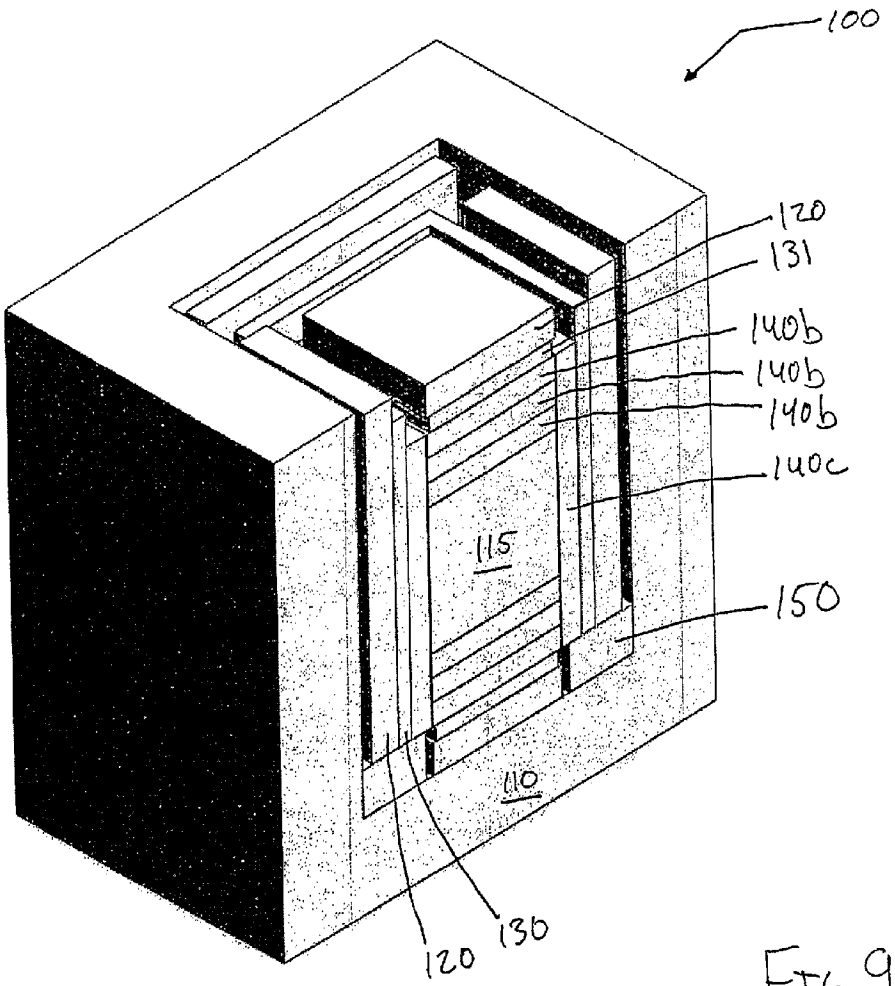

In another example, FIGS. 9*a*-9*b* also provide a contrast between the configurations of two different thermally controlled systems 100 with two different thermal requirements. In FIG. 9*a*, the inner phase change elements are provided in two vertically oriented, adjacent layers 140*c* on each side of the article 115, one horizontal layer 140*a* above and below the article 115, and an additional smaller horizontal layer 140*b* above the article 115 positioned directly adjacent to the article 115 and between portions of layers 140 that extend above the height of the article. The size of the smaller horizontal layer 140*b* above the article 115 may be specifically selected so as to allow it to fit between the vertically oriented layers 140*c*, thus allowing for a more compact configuration, and also greater modularity.

In contrast, in FIG. 9*b*, three horizontal layers of inner phase change elements 140*b* are provided between the vertically oriented layers 140*c*, both above and below the article. In this example, three layers 140*b* are possible between the layers 140*c* due to the relatively smaller size of the article 115. The modularity of the system has allowed for the easy addition of thermal capacity to be employed (more phase change elements) where the packaged article 115 is smaller. Thus, the trade-off shown and described above with regard to FIG. 3*d* between a payload size and thermal capacity is represented in the contrasting configurations of FIGS. 9*a* and 9*b*.

Modular Component Set

Modularity, of course, is not limited simply to the examples shown in FIGS. 8*a*-8*b* and 9*a*-9*b*. For example, more or fewer phase change elements may be provided. Phase change elements of different sizes may be provided. Phase change elements of different phase change materials may be provided. One or more centering rings may be provided. The buffer inserts may be variously configured with respect to one another to allow for more or fewer phase change elements to be positioned at a variety of locations within the system. Further, the enclosure may be provided in differing sizes, shapes, or materials. It is therefore envisioned that, in order to provide a highly modular system in accordance with the present disclosure that allows for a variety of payload sizes to be shipped within a variety of temperature ranges/limits and for a variety of time-at temperatures, a standard set of modular components may be employed. A standard set of components allows for a great degree of modularity (i.e., possible system configurations) while at the same time allowing for a reduced product development time and expense for novel packaging solutions, as compared to designing completely new system components for each solution, as has been done in the past.

Figure 10A:
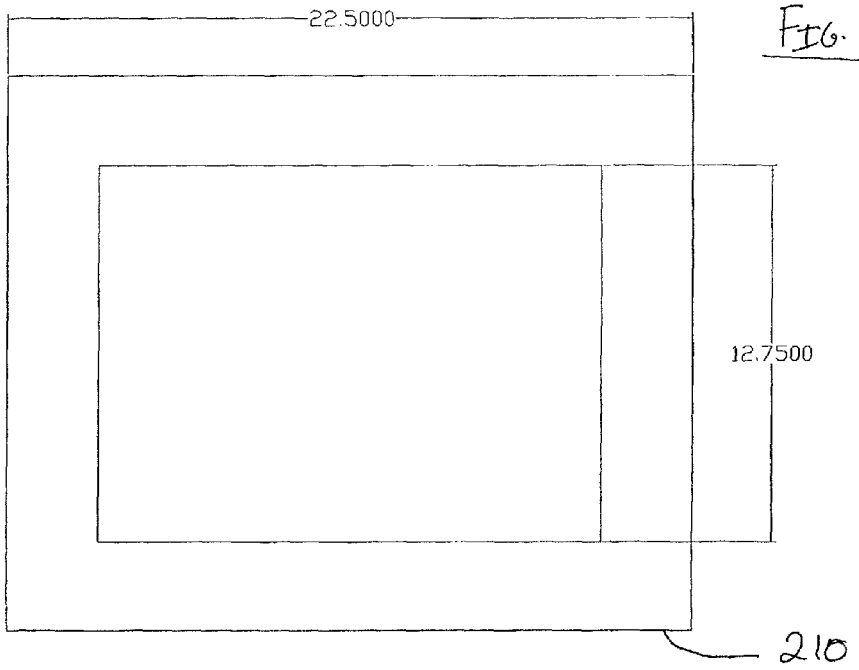
FIGS. 10*a*-10*h* show side views of example components of a modular packaging component set in accordance with the present disclosure.
Figure 10B:
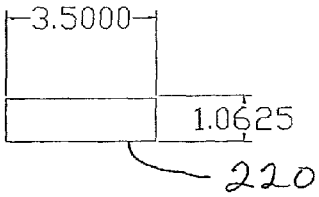
Figure 10C:
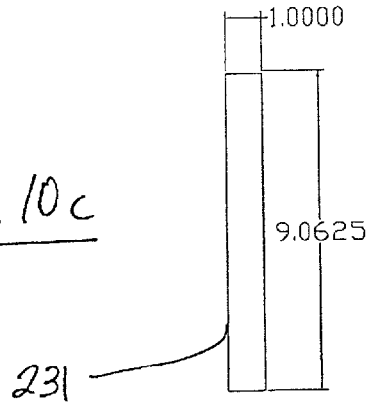
Figure 10D:
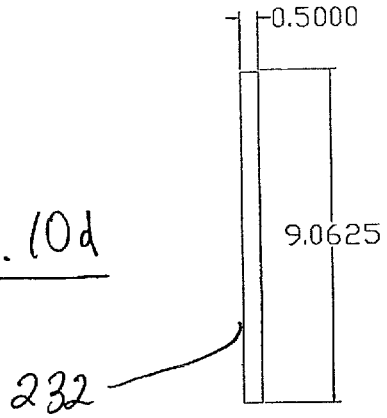
Figure 10E:
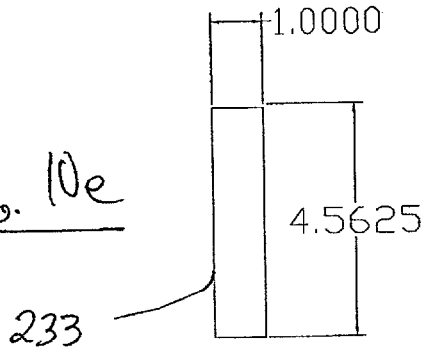
Figure 10F:
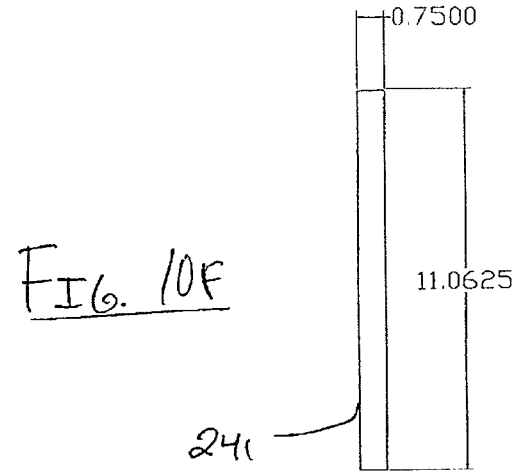
Figure 10G:
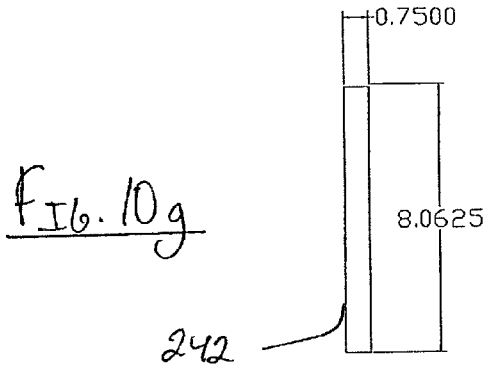
Figure 10H:
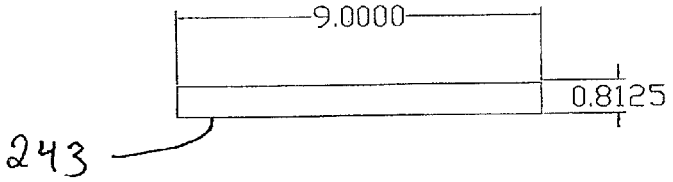

FIGS. 10*a*-10*h* depict side views of example sizes and shapes of components which may be employed in a modular component set in accordance with the present disclosure. FIG. 10*a* depicts an example rectangular enclosure 210 having length and width dimensions of 22.5 inches by 12.75 inches. It will be appreciated that this enclosure is merely exemplary, and that other sizes of enclosures 210 are possible. Furthermore, more than one size or shape of enclosure may be part of a component set. FIG. 10*b* depicts and example side of a centering ring 220 having a width of 3.5 inches and a height of 1.0625 inches. Of course, other sizes, or multiple sizes of centering rings are possible, within a given component set. FIGS. 10*c*-10*e* depict three example phase change element sizes 231, 232, and 233 (with width/height of 1 inch by 9.0625 inches, 0.5 inch by 9.0625 inches, and 1.0 inch by 4.5625 inches, respectively). Of course, other sizes are possible, as are components sets with more or fewer than three phase change element sizes. FIGS. 10*f*-10*g* depict two example buffer insert sizes 241, 242 (with width/height of 0.75 inch by 11.0625 inches and 0.75 inches by 8.0625 inches, respectively). Of course, other sizes are possible, as are components sets with more or fewer than two buffer insert sizes. Additionally, FIG. 10*h* depicts an example buffer pad 243 having length and height dimensions of 9 inches by 0.8125 inch. In any given component set, other sizes of buffer pad are possible, and more than one size of buffer pad may be provided.

In addition to various sizes and shapes, components of a modular component set in accordance with the present disclosure may be made of different materials. As one example of a common material set used in a modular system, with reference to the key shown in FIG. 11*f* and to FIGS. 10*a*-10*h*, the enclosure 210, centering ring 220, buffer inserts 241, 242, and buffer pad 243 may be made of either expanded polystyrene (EPS) (shown by the pattern associated with reference character "A") or polyurethane (PUR) (shown by the pattern associated with reference character "B"). Of course, other materials are possible for the above listed components, and the disclosure is not limited by the two exemplary materials provided. Furthermore, the phase change elements 231, 232, 233, depending on the temperature range/limit desired, may be made with any of five phase change materials shown (−25° C. phase change material shown by the pattern associate with reference character "C", 0° C. material with reference character "D", 4° C. material with reference character "E", 18° C. material with reference character "F", and 23° C. material with reference character "G"). Of course, any number of phase change materials may be used with a given component set, as well as materials with any phase change temperature, as described above.

FIGS. 11*a*-11*e* show five example packing system 100 configurations that are possible using the components 210, 220, 231-233, and 241-243, described above, being made of the materials (A)-(G), also described above. FIGS. 11*a*-11*e* are presented in side view, such that the components shown therein correspond to the side views of the components shown in FIGS. 10*a*-10*h*. In the figures, components are shown with their respective materials by the patterns listed in FIG. 11*f*, and also by reference numeral identification that includes a suffix (A)-(G), as appropriate. Thus, in FIGS. 11*a*-11*e*, a phase change element having a size of 1 inch by 9.0625 inches (FIG. 10*a*, numeral 231), made of a 0° C. phase change material (FIG. 11*f*, pattern "D"), is identified by reference numeral 231D (in addition to the "speckled" pattern shown with respect thereto in FIG. 11*f*).

In general terms, the example of FIG. 11*a*, having smaller phase change elements 233 made of a single −25° C. phase change material may be suitable for providing thermal protection to a larger payload for a shorter period of time (e.g., 24 hours, 48 hours), below a temperature limit of −25° C. Note the four centering rings 220A employed to maintain the smaller phase change elements 233C in an optimal position. The example of FIG. 11*b*, having larger phase change elements 231, 232 made of two different phase change materials (18° C., 23° C.) may be suitable for maintaining a payload for a longer period of time (e.g., 72, 96, 120 hours) within a temperature range of 18 to 23° C. The examples of FIGS.

11*c*-11*e* also employ larger phase change elements 231 (the example of FIG. 11*c* providing the greatest number thereof) for a longer time at temperature (72, 96, or, as likely with FIG. 11*c*, 120 hours), maintaining a temperature range of 0 to 4° C.

Figure 11A:
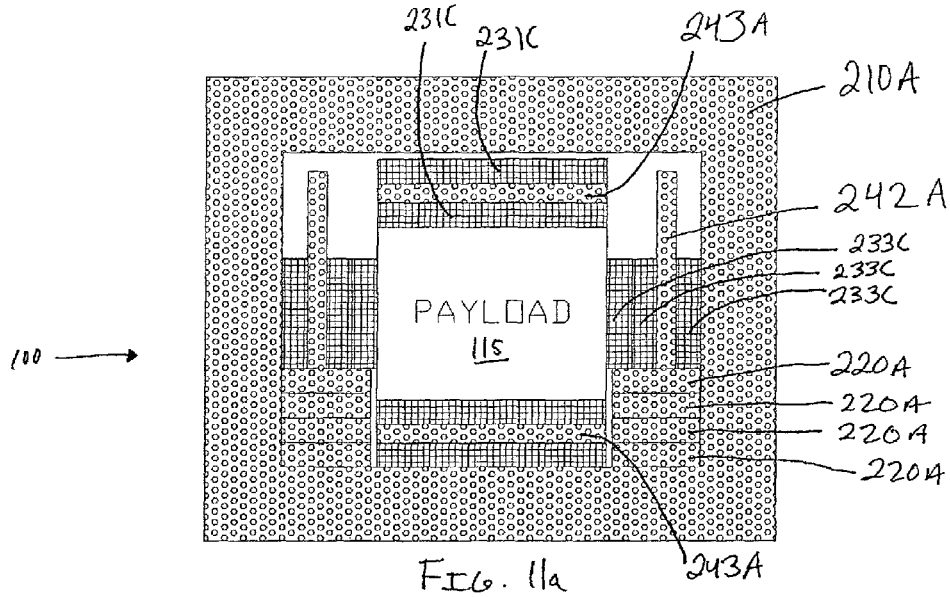
FIGS. 11*a*-11*e* show cross-sectional views of example modular packaging system configurations using the modular packaging component set of FIGS. 10*a*-10*h*.
Figure 11B:
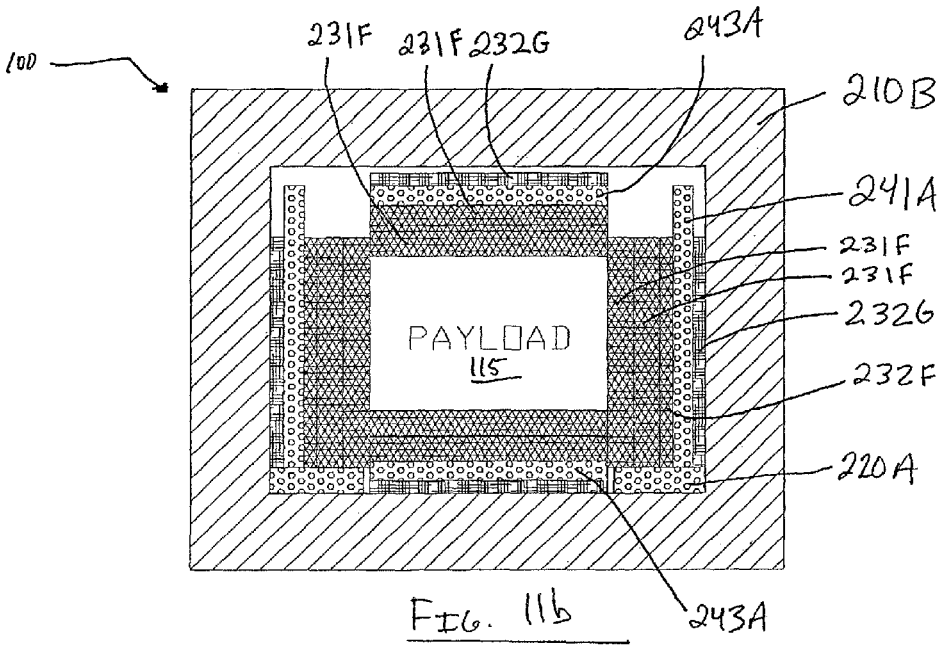
Figure 11C:
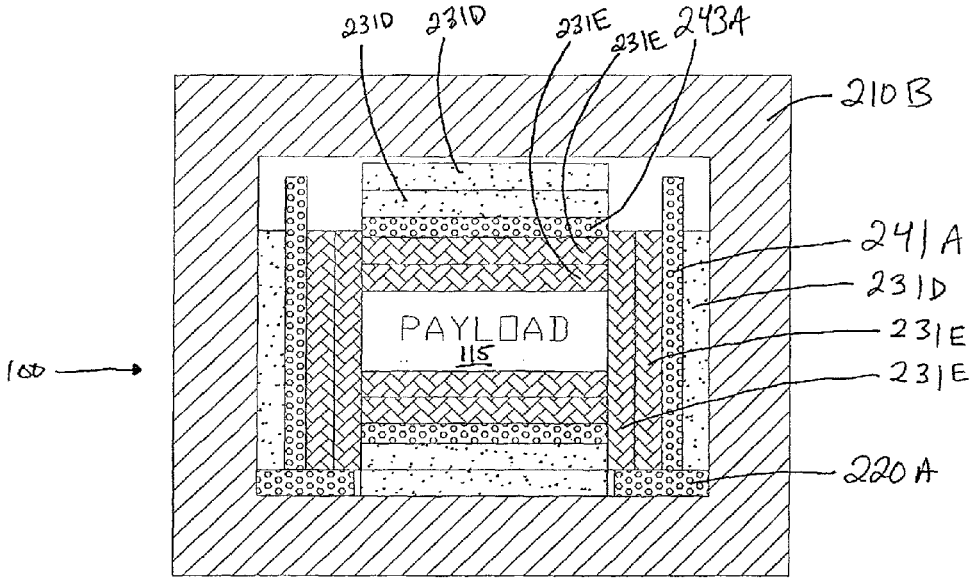
Figure 11D:
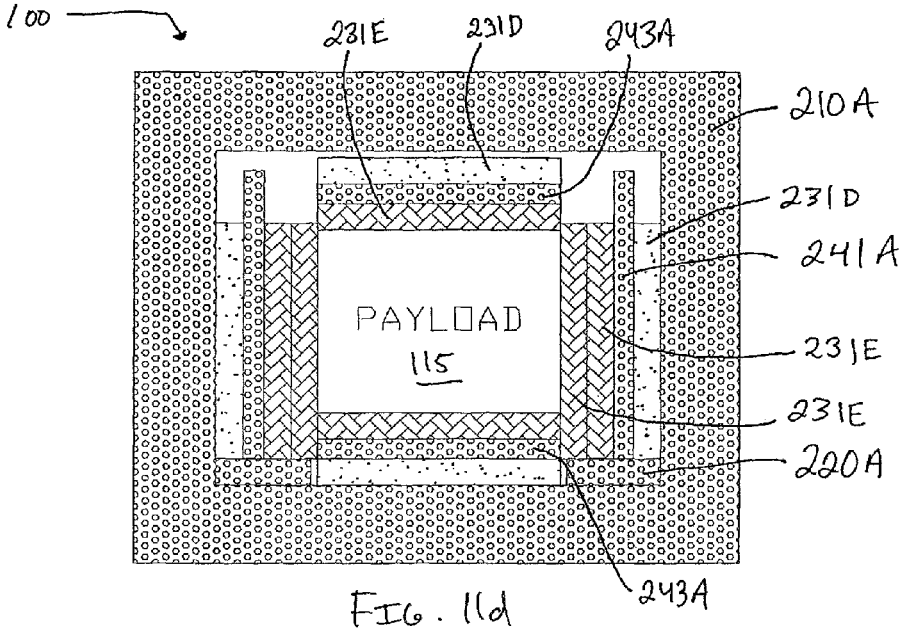
Figure 11E:
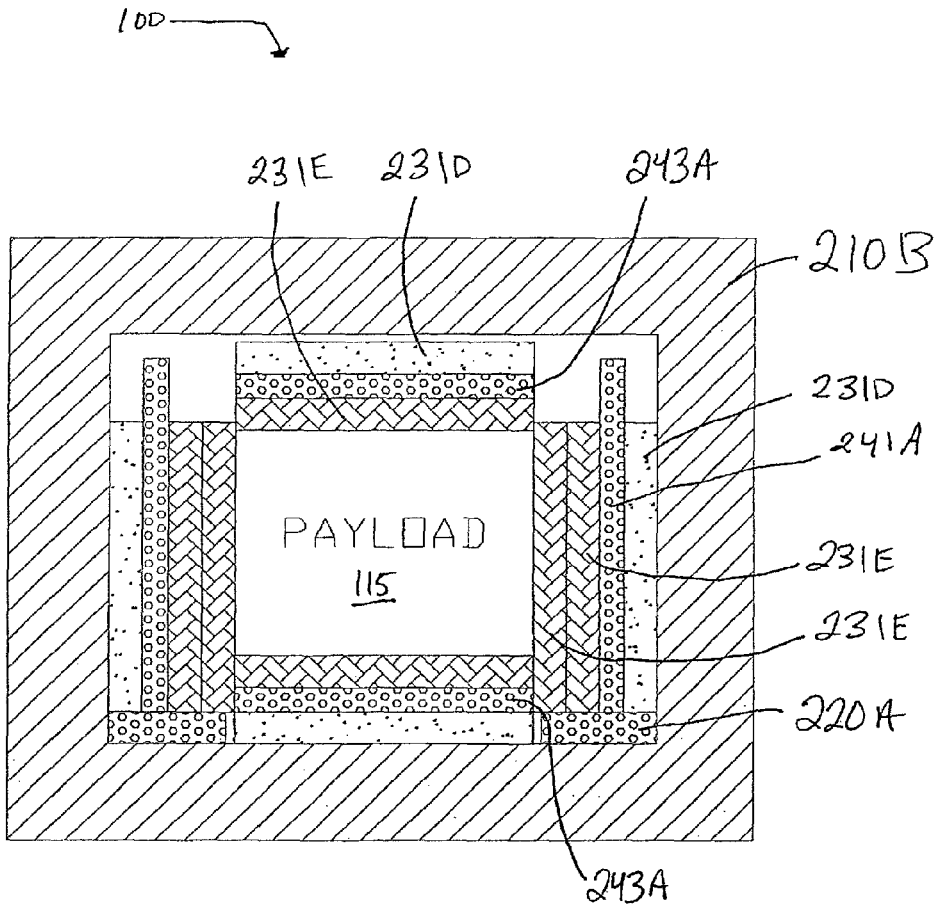
Figure 11F:
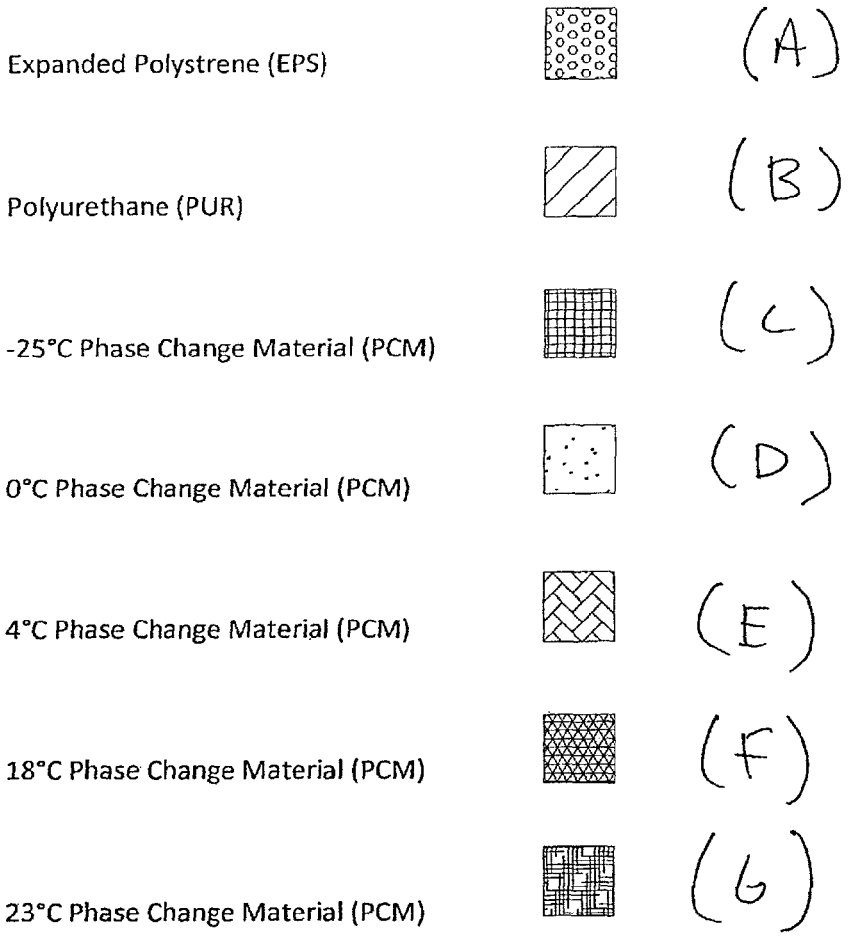
FIG. 11*f* is a reference key chart for identifying the modular components shown in FIGS. 11*a*-11*e*.

With regard to FIGS. 11*a* and 11*d*, the enclosure 210A is made of EPS, whereas in FIGS. 11*b*, 11*c*, and 11*e*, the enclosure 210B is made of PUR. As will be appreciated, PUR is a better insulating material than EPS, and thus may be suitable for applications where a longer time-at-temperature is required. EPS, however, is less expensive, and may therefore be used in applications where a long time-at temperature is not required. Buffer inserts, buffer pads, and centering rings, in all examples shown, are made of EPS. Furthermore, comparing all examples 11*a*-11*e*, the number and size of phase change elements provided changes as the payload size 115 changes. In connection therewith, it will be appreciated that the buffer inserts 241, 242 are variously configured in each instance to provide the most secure positioning of phase change elements within the enclosure (also note that in FIG. 11*a*, the smaller buffer insert 242 is employed to accommodate the additional centering rings 220).

In some embodiments, a modular component set in accordance with the present disclosure may be designed with respect to a "standard" or commonly used configuration. Such standard configuration may represent a particular temperature limit/range and/or time-at-temperature that is commonly employed to transport articles, or has many applications therefor. Variations from this standard configuration may then be accomplished by substituting standard components for other components, adding or removing components from the standard configuration, or re-configuring variously configurable components from their standard configuration.

For example, with regard to the configurations shown in FIGS. 11*a*-11*e*, and with further reference to the chart shown in FIG. 3*d*, FIG. 11*e* may be thought of as a standard configuration, and FIGS. 11*a*-11*d* as variant therefrom, effected by selecting from the available sert of modular elements. As described above, the configuration of FIG. 11*e* may be generally suitable for a time-at-temperature of about 72 hours or more, within a temperature range of 2 to 8° C. These time and temperature requirements are common in a wide variety of shipping applications (2 to 8° C. is refrigerated just above the freezing point, which is suitable to preserve many temperature-sensitive products, and 72 hours is typically sufficient for a product to be shipped on most carriers from its origin to its destination), and therefore it would be anticipated that the configuration of FIG. 11*e* would be a commonly employed configuration. In FIG. 3*d*, the standard configuration of FIG. 11*e* is positioned generally centrally within the chart, with arrows emanating therefrom representing variations from the standard configuration.

Variations from the standard configuration are easily accomplished. For example, in order to reduce the time-at-temperature requirement from the standard 72 hours to 48 hours, the less expensive, though less insulative EPS container 210A may be employed in place of the PUR container 210B of the standard configuration, keeping all other things constant. This is the configuration of FIG. 11*d* (also shown in FIG. 3*d* directly above the standard configuration, with an upward facing arrow pointing thereto). Conversely, if a longer time-at-temperature than standard is required for some application, more phase change material can be added, thus increasing the thermal capacity, all other things constant. This, of course, results in less available payload volume, as indicated in FIG. 3*d* with the reduction from 8 L volume to 5 L volume at 96 hours. This is the configuration of FIG. 11*c*. In order to change the temperature range from the standard configuration, phase change elements having different phase change materials may be substituted. For example, as shown in FIG. 3*d*, the temperature range may be increased to 15 to 30° C. This is the configuration of FIG. 11*b*. In a further variation, a temperature limit, rather than range, may be required. In this case, a phase change elements of a single phase change material may be substituted for the standard two phase configuration. This is the configuration of FIG. 11*a* (top left portion of the chart, FIG. 3*d*). Also note that, as shown in FIG. 3*d*, for this variation, the time-at-temperature is only 24 hours, and thus the less expensive EPS may be used, in addition to using smaller than standard phase change element sizes as less thermal capacity is required.

It will be appreciated that in variations where more or fewer phase change elements are required than the standard configuration, the buffer inserts may adjusted (or substituted) so as to provide the required space and structural support for such phase change elements, either adjacent to the article or adjacent to the container walls. Compare, for example, FIG. 11*e* with 11*b*, where a smaller amount of outer phase change material is required, but a larger amount of inner phase change material is required. The buffer inserts are adjusted outwardly (i.e., defining a larger perimeter in FIG. 11*b* than in FIG. 11*e*) to accommodate the larger volume of inner phase change material and the smaller volume of outer phase change material. Compare also, for example, FIG. 11*e* with 11*a*, where a smaller amount of overall phase change material is required. In this case, shorter buffer inserts may be employed, in connection with one or more centering elements (four shown in FIG. 11*a*), to centrally support the smaller phase change elements on top of the centering rings.

Thus, designing the modular component set with a standard configuration in mind allows the component set to easily serve its most widely employed applications, while at the same time being sufficiently modular to quickly and efficiently be adapted to other applications.

Of course, the various components of the example component set described herein are capable of building numerous system configurations in additions to the example configurations shown in FIGS. 11*a*-11*e*. The particular components used depend on the desired properties of the system, which include payload size, temperature range/limit, and time-at-temperature, among others.

As used herein, the terms "front," "back," and/or other terms indicative of direction are used herein for convenience and to depict relational positions and/or directions between the parts of the embodiments. It will be appreciated that certain embodiments, or portions thereof, can also be oriented in other positions. In addition, the term "about" should generally be understood to refer to both the corresponding number and a range of numbers. In addition, all numerical ranges herein should be understood to include each whole integer within the range. While an illustrative embodiment of the invention has been disclosed herein, it will be appreciated that numerous modifications and other embodiments may be devised by those skilled in the art. Therefore, it will be understood that the appended claims are intended to cover all such modifications and embodiments that come within the spirit and scope of the present disclosure.

What is claimed is:

1. A modular container for maintaining an article under controlled temperature conditions comprising:

a generally rectangular box-shaped enclosure defining an interior volume, wherein at least one enclosure side comprises an access opening to allow for insertion or removal of the article within the interior volume, and wherein enclosure sides are made of an insulating material;

at least two first phase change elements comprising a first phase change material and disposed within said enclosure, wherein each of said at least two first phase change elements are positioned adjacent one of a pair of opposed enclosure sides;

at least two buffer inserts releasably interconnected and disposed within said enclosure, wherein each of the at least two buffer inserts is positioned adjacent to one of the at least two first phase change elements on an opposite side thereof from the sides of the enclosure to define a payload volume for the article;

at least two second phase change elements comprising a second phase change material and disposed within said enclosure, wherein each of said at least two second phase change elements are positioned adjacent to one of the at least two buffer inserts on an opposite side thereof from the first phase change elements, and wherein the second phase change material changes phase at a different temperature than the first phase change material; and a centering element disposed within said enclosure, wherein said centering element is positioned adjacent to a side of the enclosure that is perpendicular to an orientation of the at least two first phase change elements, and wherein said centering element provides at each of the pair of opposed enclosures sides adjacent to the first phase change elements centering support to position each of said two first phase change elements generally centrally relative to one opposed side of the article within the interior volume.

2. The modular container of claim 1, wherein the centering element comprises a centering ring.

3. The modular container of claim 1, wherein the enclosure comprises a structurally rigid insulating material.

4. The modular container of claim 3, wherein the structurally rigid insulating material is a composite material.

5. The modular container of claim 1, wherein each of the at least two first phase change elements and the at least two second phase change elements comprises a panel of enclosed phase change material.

6. The modular container of claim 5, wherein the enclosed phase change material is loaded on a phenolic foam-based substrate.

7. The modular container of claim 5, wherein the enclosed phase change material is a liquid, gel, or other hydrocolloid material.

8. The modular container of claim 1, wherein the at least two first phase change elements are in a solid phase and the at least two second phase change elements are in a liquid phase.

9. The modular container of claim 8, wherein the at least two first phase change elements provide an upper temperature limit and the at least two second phase change elements provide a lower temperature limit, thereby maintaining the article within a temperature range.

10. The modular container of claim 1 comprising six first phase change elements and six second phase change elements, thereby providing thermal protection for each side of the enclosure.

11. The modular container of claim 1, wherein the at least two first phase change elements differ in size from the at least two second phase change elements.

12. The modular container of claim 1 comprising four first phase change elements and four second phase change elements.

13. The modular container of claim 12, wherein two of the four first phase change elements differ in size from two other of the four first phase change elements.

14. The modular container of claim 1 comprising an additional first phase change element positioned adjacent to one of the at least two first phase change elements, thereby providing additional thermal capacity to the modular container.

15. The modular container of claim 1 wherein said centering element is positioned in supporting contact with the at least two first phase change elements so as to support said first phase change elements securely and centrally about the article.

16. The modular container of claim 1, wherein the at least two buffer inserts comprise a structurally rigid insulating material, thereby reducing conductive heat flow between the first and second phase change elements.

17. The modular container of claim 1, wherein the at least two buffer inserts comprise modular adaptations to provide selective configurability to accommodate various sized articles to be packaged within the container.

18. The modular container of claim 17, wherein the modular adaptations comprise one or more opposing pairs of thin cut-outs, located on lateral edges of the buffer inserts, to allow for the at least two buffer inserts to be interlocked with one another by sliding the cut-out of one of the at least two buffer inserts over the cut-out of another of the at least two buffer inserts.

19. The modular container of claim 1 comprising four buffer inserts interconnected at modular adaptations thereof to form a four-sided barrier between the first phase change elements and the second phase change elements.

20. The modular container of claim 1 comprising an additional centering element positioned adjacent to the centering element, thereby allowing a relatively smaller phase change element to be generally side-centered with respect to the article.

21. The modular container of claim 1, wherein the at least two buffer inserts are selectively interconnectable with each other to define a larger or a smaller payload volume for the article.

22. The modular container of claim 1, further comprising a selected additional first phase change element or second phase change element positioned adjacent to a like phase change element within the enclosure, wherein adjacent, like phase change elements form a double-thickness layer of phase change elements.

23. The modular container of claim 1, wherein the at least two first phase change elements and/or the at least two second phase change elements comprises phase change elements of differing sizes.

24. The modular container of claim 23, wherein phase change elements of differing sizes are partitioned from a single phase change element base platform.

25. The modular container of claim 23, wherein one of the at least two first phase change elements and/or the at least two second phase change elements is one half or one quarter the size of another of the at least two first phase change elements and/or the at least two second phase change elements.

26. The modular container of claim 1, wherein the at least two buffer inserts are interconnectable with each other to define an inner volume and an outer volume, the first volume being outside of a perimeter defined by the buffer inserts, between the buffer inserts and sides of the enclosure, and the second volume being within the perimeter defined by the buffer inserts, wherein the article is disposed within the second volume, and wherein the interconnectability of the buffer inserts is selectively configurable to allow relative proportions of the inner and outer volumes to be adjusted to accommodate various sizes of phase change elements being disposed therein.

27. The modular container of claim 26, wherein the interconnectability of the buffer inserts is selectively configured so as to minimize empty air space within the inner and outer volumes when the phase change elements are disposed therein.

28. The modular container of claim 26, wherein the at least two first or second phase change elements are selected from a set of modular phase change elements, designed for use in multiples and for interchangeability.

29. The modular container of claim 26, wherein the at least two first or second phase change elements are selected from a set of modular phase change elements, and employ at least one phase change material selected with a targeted phase change temperature, that permits a modular phase change element to achieve a thermal performance that differs depending on the targeted phase change temperature.

30. The modular container of claim 26, wherein the at least two first or second phase change elements are selected from a set of modular phase change elements, and a multiple of modular phase change elements is used to achieve a selected thermal performance.

31. A modular container for maintaining an article under controlled temperature conditions comprising:

a generally rectangular box-shaped enclosure defining an interior volume, wherein at least one enclosure side comprises an access opening to allow for insertion or removal of the article within the interior volume, and wherein enclosure sides are made of an insulating material;

at least two first phase change elements comprising a first phase change material and disposed within said enclosure, wherein each of said at least two first phase change elements are positioned adjacent one of a pair of opposed enclosure sides;

at least two buffer inserts disposed within said enclosure, wherein each of the at least two buffer inserts is positioned adjacent to one of the at least two first phase change elements on an opposite side thereof from the sides of the enclosure to define a payload volume for the article;

at least two second phase change elements comprising a second phase change material and disposed within said enclosure, wherein each of said at least two second phase change elements are positioned adjacent to one of the at least two buffer inserts on an opposite side thereof from the first phase change elements, and wherein the second phase change material changes phase at a different temperature than the first phase change material; and a centering element disposed within said enclosure, wherein said centering element is positioned adjacent to a side of the enclosure that is perpendicular to an orientation of the at least two first phase change elements, and wherein said centering element is positioned in supporting contact with the at least two first phase change elements so as to support said elements generally centrally along the respective side of the enclosure to which said elements are adjacent;

wherein the centering element comprises an open generally rectangular shape to allow a phase change element to be disposed within an interior portion thereof.

32. The modular container of claim 31 further comprising:

an additional first phase change element or second phase change element positioned adjacent to a like phase change element within the enclosure, wherein the additional phase change element provides additional thermal capacity to the modular container.

33. The modular container of claim 31, further comprising:

at least four phase change elements disposed within said enclosure, two of which being disposed adjacent to a first side of the enclosure and the other two of which being disposed adjacent to a second side of the enclosure;

wherein the at least two buffer inserts are selectively interconnectable with each other to define a larger or a smaller payload volume for the article and to provide structural support to maintain the phase change elements in their respective positions.

34. The modular container of claim 33, wherein said centering element is positioned adjacent to a side of the enclosure that is perpendicular to an orientation of the four phase change elements, and wherein said centering element is positioned in supporting contact with the four phase change elements so as to support said elements generally centrally along the respective side of the article to which said elements are adjacent.

* * * * *

UNITED STATES PATENT AND TRADEMARK OFFICE

CERTIFICATE OF CORRECTION

PATENT NO. : 8,938,986 B2
APPLICATION NO. : 13/342761
DATED : January 27, 2015
INVENTOR(S) : Auston R. Matta et al.

It is certified that error appears in the above-identified patent and that said Letters Patent is hereby corrected as shown below:

Title Page, item [57]
At Abstract, lines 13-14:
"a second phase change material, to one of the at least two buffers inserts wherein the second"
should read:
--a second phase change material, wherein the second--

In the Specification
At column 11, line 2:
"cover film 206 (FIG. 40 which"
should read:
--cover film 206 (FIG 4f) which--

At column 14, line 26:
"to the thickness or the phase"
should read:
--to the thickness of the phase--

At column 14, line 59:
"and sized to lit within"
should read:
--and sized to fit within--

At column 15, line 64:
"in FIGS. 7b"
should read:
--in FIG. 7b--

Signed and Sealed this
Nineteenth Day of May, 2015

Michelle K. Lee

Michelle K. Lee
*Director of the United States Patent and Trademark Office*

In the Claims

At column 21, line 28 (Claim 1, Line 33):

"opposed enclosures sides adjacent to the first"

should read:

--opposed enclosure sides adjacent the two first--